US010711438B2

(12) United States Patent
Fukuda

(10) Patent No.: US 10,711,438 B2
(45) Date of Patent: Jul. 14, 2020

(54) HYDRAULIC SYSTEM FOR WORKING MACHINE

(71) Applicant: KUBOTA CORPORATION, Osaka (JP)

(72) Inventor: Yuji Fukuda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 189 days.

(21) Appl. No.: 15/854,156

(22) Filed: Dec. 26, 2017

(65) Prior Publication Data

US 2018/0266080 A1 Sep. 20, 2018

(30) Foreign Application Priority Data

Mar. 15, 2017 (JP) ..... 2017-050418

(51) Int. Cl.

| | |
|---|---|
| ***E02F 9/22*** | (2006.01) |
| ***F15B 13/042*** | (2006.01) |
| ***E02F 3/34*** | (2006.01) |

(52) U.S. Cl.

CPC ..... *E02F 9/2267* (2013.01); *E02F 3/3414* (2013.01); *E02F 9/226* (2013.01); *E02F 9/2225* (2013.01); *E02F 9/2253* (2013.01); *E02F 9/2285* (2013.01); *E02F 9/2289* (2013.01); *F15B 13/0426* (2013.01); *F15B 13/0422* (2013.01); *F15B 2013/0428* (2013.01); *F15B 2211/329* (2013.01); *F15B 2211/355* (2013.01); *F15B 2211/50518* (2013.01); *F15B 2211/526* (2013.01); *F15B 2211/62* (2013.01); *F15B 2211/633* (2013.01); *F15B 2211/6343* (2013.01); *F15B 2211/6346* (2013.01); *F15B 2211/6355* (2013.01); *F15B 2211/6658* (2013.01); *F15B 2211/67* (2013.01);

(Continued)

(58) Field of Classification Search

CPC .... F15B 21/042; F15B 21/0427; E02F 9/2267

See application file for complete search history.

(56) References Cited

U.S. PATENT DOCUMENTS

2016/0230370 A1* 8/2016 Fukuda ..... F16H 61/4008

FOREIGN PATENT DOCUMENTS

| | | | |
|---|---|---|---|
| JP | H10259809 | * | 9/1998 |
| JP | 5809544 | | 9/2015 |

* cited by examiner

*Primary Examiner* — Michael Leslie
*Assistant Examiner* — Daniel S Collins
(74) *Attorney, Agent, or Firm* — Greenblum & Bernstein, P.L.C.

(57) ABSTRACT

A hydraulic system includes a hydraulic pump to output an operation fluid, a hydraulic apparatus to be activated by the operation fluid, an operating member to operate the hydraulic apparatus, an operation valve to determine a pressure of the operation fluid in accordance with operation of the operating member, the operation fluid being supplied to the hydraulic apparatus, a first fluid tube connecting the hydraulic pump to the operation valve, a first working valve disposed on the first fluid tube, the first working valve being configured to change an opening aperture of the first working valve, a first outputting fluid tube connected to a section of the first fluid tube between the operation valve and the first working valve, and a second working valve disposed on the first outputting fluid tube, the second working valve being configured to change an opening aperture of the second working valve.

12 Claims, 14 Drawing Sheets

(52) U.S. Cl.
CPC ... *F15B 2211/7058* (2013.01); *F15B 2211/75* (2013.01); *F15B 2211/851* (2013.01); *F15B 2215/30* (2013.01)

80
30A
81a
81b
81c
82
83
86
54
55C
55A
52
55B
55
55D
L
R
F
B
40b
72C
72b
72a
75
72
40c
51b
51
33
R3
71
R2
R1
73
74
42
22
72B
72A
71a
71b
51a
40a
31L
23
m
38a
38A
36
40
R1
24
R2
38b
35
37
34
34R
34L
57i
57i
53a
53
53b
53b
53
53a
P1
P2
32
57h
57h
22
38A
36
24
R2
23
m
35
37
31R

HYDRAULIC SYSTEM FOR WORKING MACHINE

CROSS-REFERENCE TO RELATED APPLICATIONS

The present application claims priority under 35 U.S.C. § 119 to Japanese Patent Application No. 2017-050418, filed Mar. 15, 2017. The content of this application is incorporated herein by reference in their entirety.

BACKGROUND OF THE INVENTION

Field of the Invention

The present invention relates to a hydraulic system for a working machine such as a skid steer loader, a compact track loader, and the like.

Discussion of the Background

Japanese Patent Publication No. 5809544 previously discloses a technique for warming up a working machine.

The working machine disclosed in Japanese Patent Publication No. 5809544 includes a pilot pressure control valve and a valve body. The pilot pressure control valve is configured to control a pressure of a pilot fluid outputted from a pump and sent to a supplying target. The valve body incorporates the pilot pressure control valve. In the working machine disclosed in Japanese Patent Publication No. 5809544, the valve body is provided with a heat-up fluid tube into which the pilot fluid outputted from the pump is supplied, the pilot fluid supplied into the heat-up fluid tube is supplied to an operation fluid tank through a relief valve or a throttle, and thereby the valve body is heated up.

SUMMARY OF THE INVENTION

A hydraulic system for a working machine of the present invention, includes a hydraulic pump to output an operation fluid, a hydraulic apparatus to be activated by the operation fluid, an operating member to operate the hydraulic apparatus, an operation valve to determine a pressure of the operation fluid in accordance with operation of the operating member, the operation fluid being supplied to the hydraulic apparatus, a first fluid tube connecting the hydraulic pump to the operation valve, a first working valve disposed on an intermediate portion of the first fluid tube, the first working valve being configured to change an opening aperture of the first working valve, a first outputting fluid tube connected to a section of the first fluid tube between the operation valve and the first working valve, and a second working valve disposed on the first outputting fluid tube, the second working valve being configured to change an opening aperture of the second working valve.

Another hydraulic system for a working machine of the present invention, includes a hydraulic pump to output an operation fluid, a hydraulic apparatus to be activated by the operation fluid, an operating member to operate the hydraulic apparatus, an operation valve to determine a pressure of the operation fluid in accordance with operation of the operating member, the operation fluid being supplied to the hydraulic apparatus, a first fluid tube connecting the hydraulic pump to the operation valve, a first working valve disposed on an intermediate portion of the first fluid tube, the first working valve being configured to change an opening aperture of the first working valve and having a first port to output the operation fluid, a first outputting fluid tube connected to a section of the first fluid tube between the operation valve and the first working valve, a second working valve disposed on the first outputting fluid tube, the second working valve being configured to change an opening aperture of the second working valve and having a second port to output the operation fluid, a second outputting fluid tube connecting the first port of the first working valve to the second port of the second working valve, the second outputting fluid tube being connected to the first outputting fluid tube, and a check valve to supply the operation fluid from the section of the first fluid tube to the second fluid tube and to block the operation fluid flowing from the second fluid tube toward the second fluid tube.

Further another hydraulic system for a working machine of the present invention, includes a hydraulic pump to output an operation fluid, a hydraulic apparatus to be activated by the operation fluid, an operating member to operate the hydraulic apparatus, an operation valve to determine a pressure of the operation fluid in accordance with operation of the operating member, the operation fluid being supplied to the hydraulic apparatus, a first fluid tube connecting the hydraulic pump to the operation valve, a first working valve disposed on an intermediate portion of the first fluid tube, the first working valve being configured to change an opening aperture of the first working valve and having a first port to output the operation fluid, a first outputting fluid tube connected to a section of the first fluid tube between the operation valve and the first working valve, a second working valve disposed on the first outputting fluid tube, the second working valve being configured to change an opening aperture of the second working valve and having a second port to output the operation fluid, a second outputting fluid tube connecting the first port of the first working valve to the second port of the second working valve, the second outputting fluid tube being connected to the first outputting fluid tube, and a relief valve disposed on the first outputting fluid tube, the relief valve being configured to relieving the operation fluid of the first outputting fluid tube toward the second outputting fluid tube side.

Further another hydraulic system for a working machine of the present invention, includes a traveling hydraulic pump to output an operation fluid, a charging hydraulic pump other than the traveling hydraulic pump, the charging hydraulic pump being configured to output the operation fluid, a traveling hydraulic motor to be activated by the operation fluid outputted from the traveling hydraulic pump, a second fluid tube connecting the traveling hydraulic pump to the traveling hydraulic motor, a third fluid tube connected to the second fluid tube, the third fluid tube being configured to supply the operation outputted from the charging hydraulic pump to the second hydraulic tube, a third outputting fluid tube connected to the third fluid tube, and a third working valve disposed on the third outputting fluid tube, the third working valve being configured to change an opening aperture of the third working valve.

Further another hydraulic system for a working machine of the present invention, includes a hydraulic pump to output an operation fluid, a working hydraulic apparatus to be activated by the operation fluid, a working operating member to operate the working hydraulic apparatus, a working operation valve to determine a pressure of the operation fluid in accordance with operation of the working operating member, the operation fluid being supplied to the working hydraulic apparatus, a fourth fluid tube connecting the working operation valve to the working hydraulic apparatus, a fourth outputting fluid tube connected to the fourth fluid tube, and a fourth working valve disposed on the fourth outputting fluid tube, the fourth working valve being configured to change an opening aperture of the fourth working valve.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
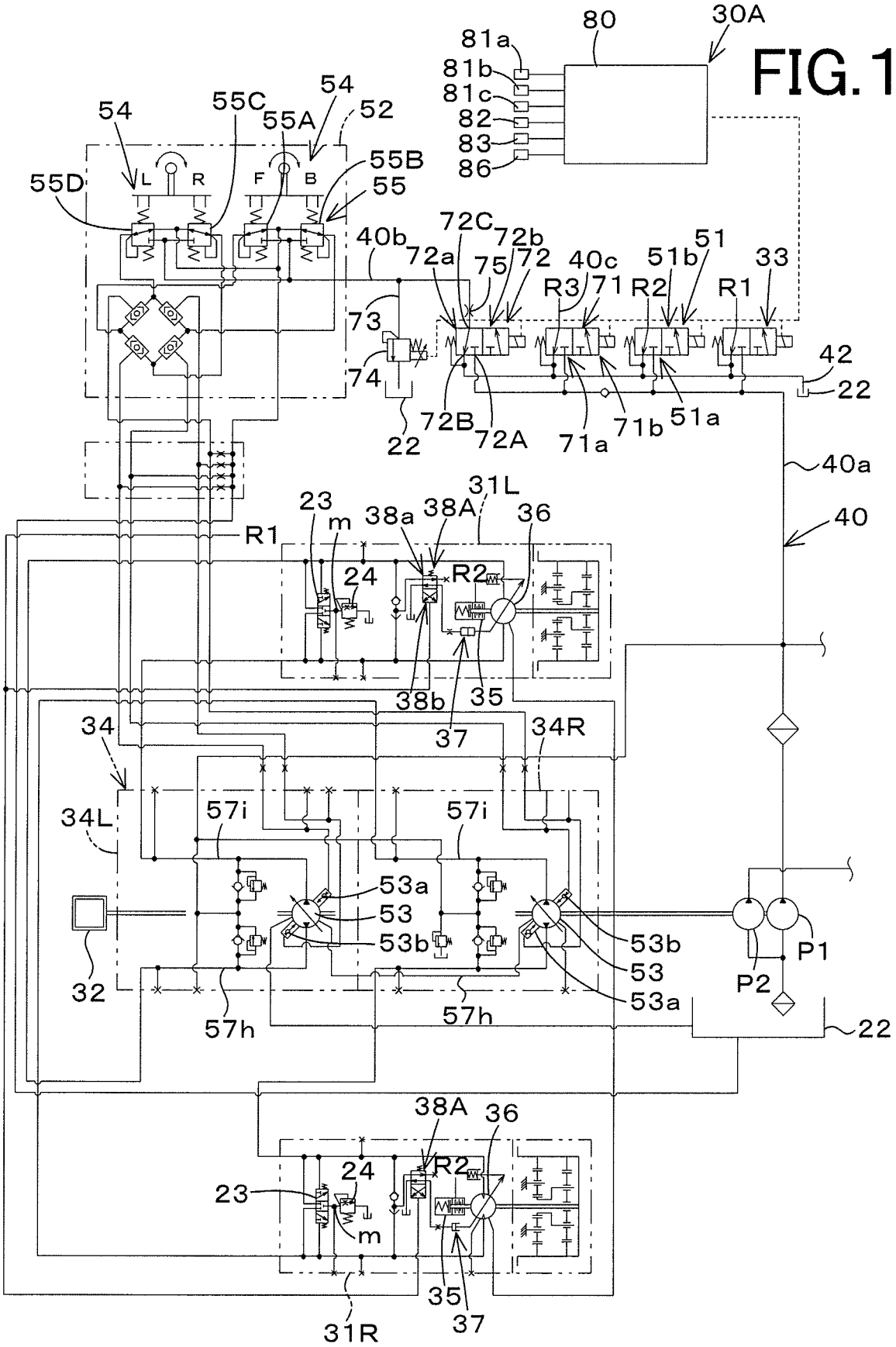
FIG. 1 is a view schematically illustrating a traveling hydraulic system according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Referring to drawings, the embodiments of the present invention, a hydraulic system for a working machine 1 and the working machine 1 having the hydraulic system, will be described below.

First Embodiment

The working machine 1 will be explained below.

Figure 8:
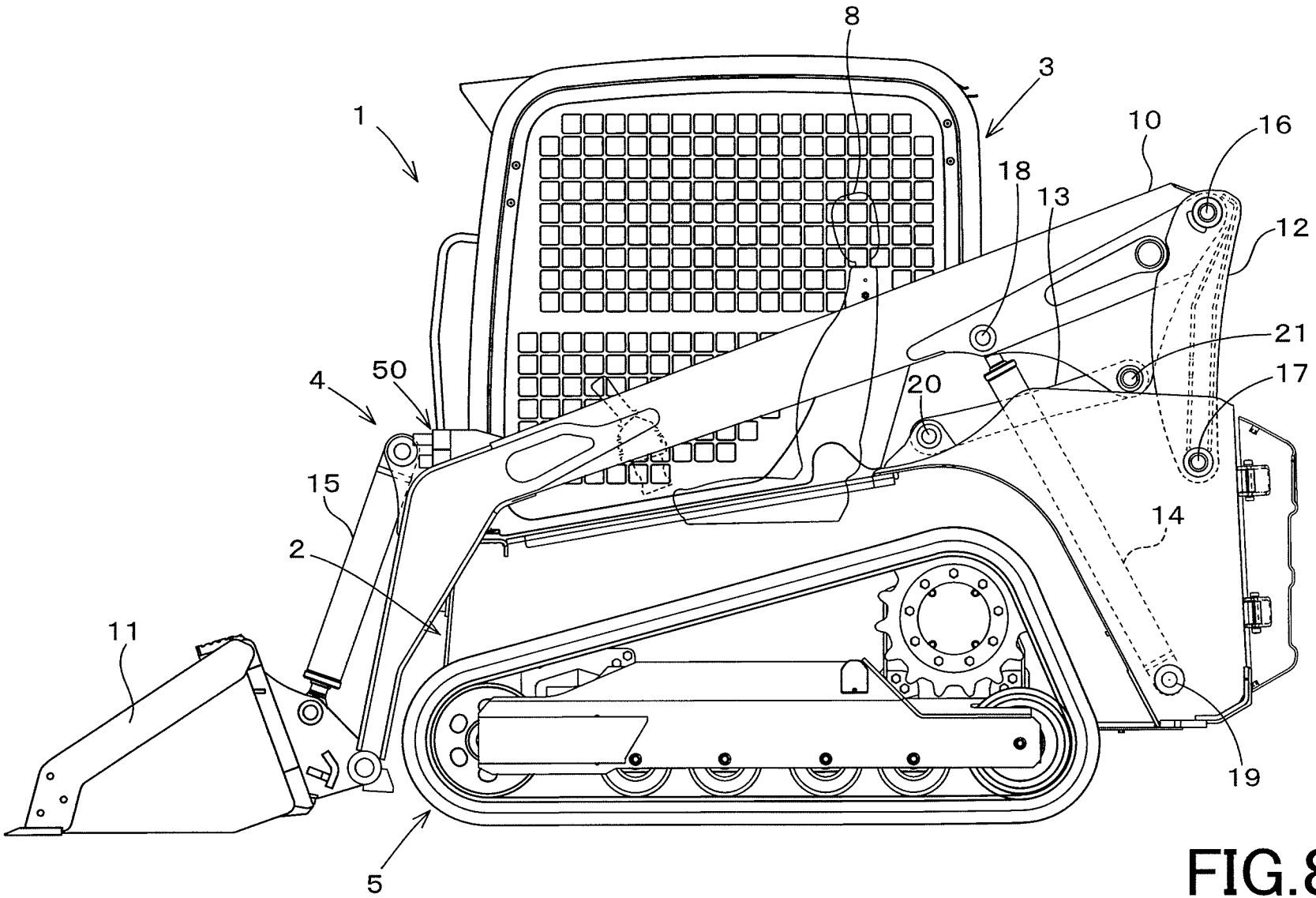
FIG. 8 is a side view illustrating a track loader as an example of a working machine according to the embodiments of the present invention.

FIG. 8 shows a side view of the working machine 1 according to the embodiments of the present invention. FIG. 8 shows a compact track loader as an example of the working machine 1. However, the working machine 1 according to the embodiments is not limited to the compact track loader. The working machine 1 may be other types of the working machine such as a Skid Steer Loader (SSL). In addition, the working machine 1 may be other types of the working machine other than a loader working machine.

Figure 9:
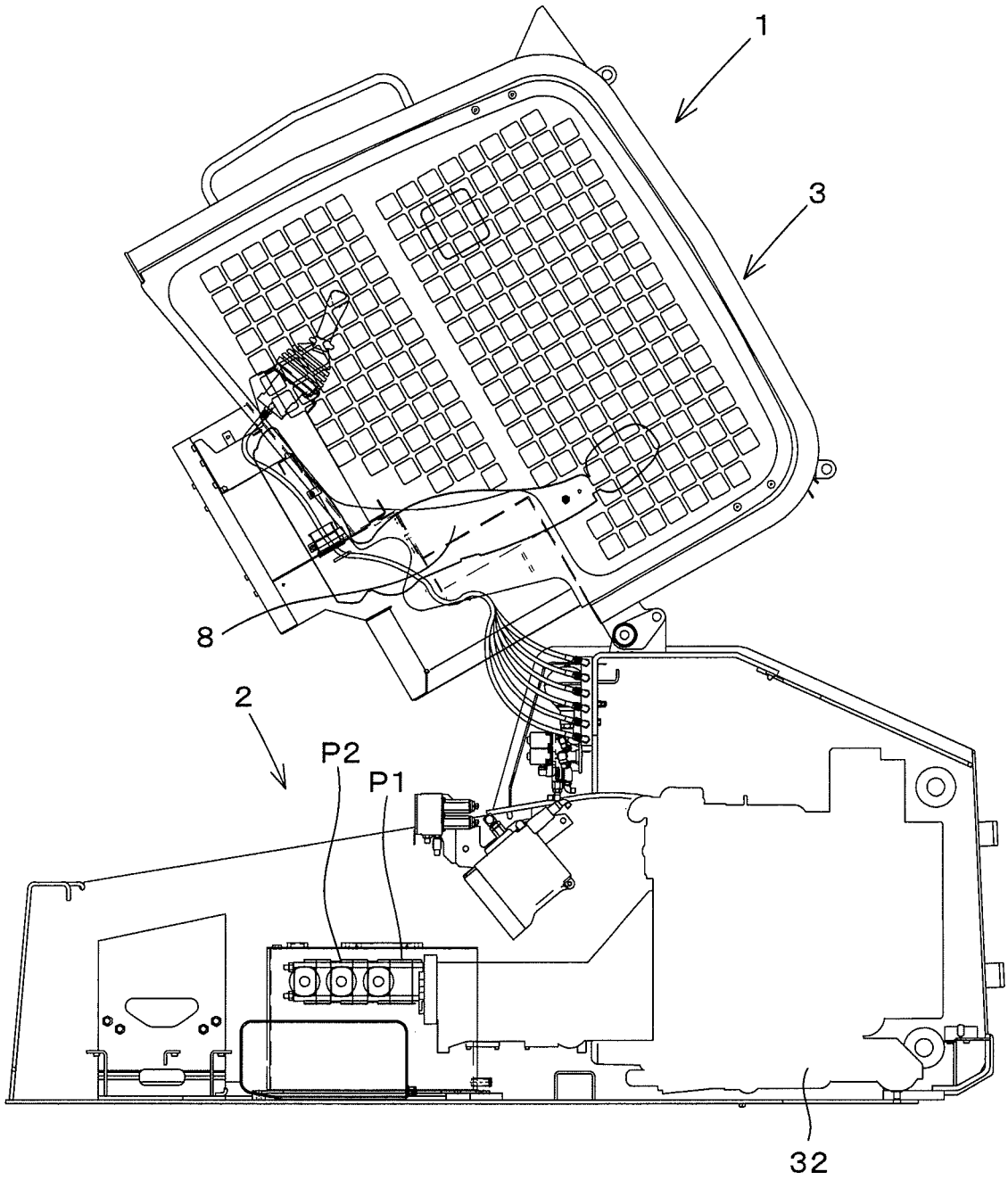
FIG. 9 is a side view illustrating a part of the track loader lifting up a cabin according to the embodiments.

As shown in FIG. 8 and FIG. 9, the working machine 1 according to embodiments of the present invention includes a machine body (a vehicle body) 2, a cabin 3, an operation device 4, and a traveling device 5. Hereinafter, in explanations of all the embodiments of the present invention, a forward direction (a left side in FIG. 8) corresponds to a front side of an operator seated on an operator seat 8 of the working machine 1, a backward direction (a right side in FIG. 8) corresponds to a back side of the operator, a leftward direction (a front surface side of the sheet of FIG. 8) corresponds to a left side of the operator, and a rightward direction (a back surface side of the sheet of FIG. 8) corresponds to a right side of the operator.

Additionally in the explanations, a machine width direction corresponds to a horizontal direction (a lateral direction) perpendicular to the front to rear direction. A machine outward direction corresponds to a direction from a center portion of the machine body 2 to the right portion of the machine body 2 and to the left portion of the machine body 2. In other words, the machine outward direction corresponds to the machine width direction, especially corresponds to a direction separating from the machine body 2. In the explanation, a machine inward direction corresponds to a direction opposite to the machine outward direction. In other words, the machine inward direction corresponds to the machine width direction, especially corresponds to a direction approaching the machine body 2 from the outside of the machine body 2.

The cabin 3 is mounted on the machine body 2. The operator seat 8 is disposed inside the cabin 3. The operation device 4 is constituted of a device configured to perform the working, the operation device 4 being attached to the machine body 2. The traveling device 5 is disposed on the outside of the machine body 2. A prime mover (an engine or an electric motor) 32 is mounted on a rear portion of the machine body 2 internally. The prime mover 7 is constituted of a diesel engine (that is, an engine). Meanwhile, the prime mover 7 is not limited to the engine, and may be constituted of an electric motor or the like.

The operation device 4 includes booms 10, a working tool 11, lift links 12, control links 13, boom cylinders 14, and bucket cylinders 15.

The operation device 4 includes two booms 10; one of the booms 10 is provided on a right side of the cabin 3 (referred to as the right boom 10) and is capable of freely swinging upward and downward, and the other one of the booms 10 is provided on a left side of the cabin 3 (referred to as the left boom 10) and is capable of freely swinging upward and downward. The working tool 11 is a bucket (hereinafter referred to as a bucket 11), for example. The bucket 11 is disposed on tip portions (front end portions) of the booms 10 and is capable of being freely swung upward and downward. The lift link 12 and the control link 13 support a base portion (a rear portion) of the boom 10 such that the boom 10 is capable of being freely swung upward and downward. The boom cylinder 14 is capable of being stretched and shortened to move the boom 10 upward and downward. The bucket cylinder 15 is capable of being stretched and shortened to swing the bucket 11.

A joint pipe having a deformed shape is connected to a front portion of the boom 10 arranged to the right and to a front portion of the boom 10 arranged to the left between the boom 10 arranged to the right and the boom 10 arranged to the left, thereby jointing the boom 10 arranged to the right and the boom 10 arranged to the left each other. The operation device 4 also includes another joint pipe having a cylindrical shape, that is, the joint pipe being a cylindrical pipe. The joint pipe is connected to a base portion (a rear portion) of the boom 10 arranged to the right and to a base portion (a rear portion) of the boom 10 arranged to the left between the boom 10 arranged to the right and the boom 10 arranged to the left, thereby jointing the boom 10 arranged to the right and the boom 10 arranged to the left each other.

The operation device 4 includes two lift links 12, two control links 13, and two boom cylinders 14. One of the lift links 12 (the right lift link 12), one of the control links 13 (the right control link 13), and one of the boom cylinders 14 (the right boom cylinder 14) are disposed on a right side of the machine body 2, corresponding to the right boom 10. And, the other one of the lift links 12 (the left lift link 12), the other one of the control links 13 (the left control link 13), and the other one of the boom cylinders 14 (the left boom cylinder 14) are disposed on a left side of the machine body 2, corresponding to the left boom 10.

The lift link 12 is vertically disposed on a rear portion of the base portion of the boom 10. The lift link 12 is pivotally supported at an upper portion (one end side) of the lift link 12 by a pivotal shaft 16 (a first pivotal shaft) to be close to a rear portion of a base portion of the boom 10, and thereby is capable of turning about a lateral shaft of the pivotal shaft 16. In addition, the lift link 12 is pivotally supported at a lower portion (the other end side) of the lift link 12 by a pivotal shaft (a second pivotal shaft) 17 to be close to a rear portion of the machine body 2, and is capable of freely turning about a lateral axis of the pivotal shaft 17. The second pivotal shaft 17 is arranged below the first pivotal shaft 16.

The boom cylinder 14 is pivotally supported at an upper portion of the boom cylinder 14 by a pivotal shaft (a third pivotal shaft) 18, and is capable of freely turning about a lateral axis of the third pivotal shaft 18. The third pivotal shaft 18 is arranged on each of base portions of the booms 10, specifically on a front portion of the base portion. The boom cylinder 14 is pivotally supported at a lower portion of the boom cylinder 14 by a pivotal shaft (a fourth pivotal shaft) 19, and is capable of freely turning about a lateral axis of the pivotal shaft 19. The fourth pivotal shaft 19 is arranged below the third pivotal shaft 18 to be close to a lower portion of the rear portion of the machine body 2.

The control link 13 is arranged forward from the lift link 12. One end of the control link 13 is pivotally supported by a pivotal shaft (a fifth pivotal shaft) 20, and is capable of freely turning about a lateral axis of the pivotal shaft 20. The fifth pivotal shaft 20 is disposed on the machine body 2, specifically on a position in front of and corresponding to the lift link 12. The other end of the control link 13 is pivotally supported by a pivotal shaft (a sixth pivotal shaft) 21, and is capable of freely turning about a lateral axis of the pivotal shaft 21. The fifth pivotal shaft 21 is disposed on the boom 10, specifically in front of the second pivotal shaft 17 and above the second pivotal shaft 17.

The boom cylinder 14 is stretched and shortened, and thereby each of the booms 10 is swung upward and downward about the first pivotal shaft 16 with the base portion of each of the booms 10 supported by the lift link 12 and the control link 13. In this manner, the tip end portion of each of the booms 10 is moved upward and downward. The control link 13 is swung upward and downward about the fifth pivotal shaft 20 in accordance with the upward swing and downward swing of the booms 10. The lift link 12 is swung forward and backward about the second pivotal shaft 17 in accordance with the upward swing and downward swing of the control link 13.

Not only the bucket 11, other working tools can be attached to the tip end (the front portion) of the boom 10. The following attachments (spare attachments) are exemplified as the other working tools; for example, a hydraulic crusher, a hydraulic breaker, an angle broom, an earth auger, a pallet fork, a sweeper, a mower, a snow blower, and the like.

A connecting member 50 is disposed on the front portion of the boom 10 arranged to the left. A hydraulic apparatus is installed on the auxiliary attachment. The connecting member 50 is a device configured to connect the hydraulic apparatus to a first tube member such as a pipe disposed on the boom 10.

In particular, the first tube member is configured to be connected to one of the connecting member 50. A second tube member is connected to the hydraulic apparatus of the auxiliary attachment. The second tube member is configured to be connected to the other end of the connecting member 50. In this manner, the operation fluid flowing in the first tube member is supplied to the hydraulic apparatus through the second tube member.

The bucket 15 is arranged close to each of the front portions of the booms 10. The bucket cylinder 15 is stretched and shortened, and thereby the bucket 11 is swung.

In the embodiment, each of the travel device 5 arranged to the left and the travel device 5 arranged to the right employs a crawler travel device (including a semi-crawler travel device). However, each of the travel device 5 arranged to the left and the travel device 5 arranged to the right may employ a wheeled travel device having a front wheel and a rear wheel.

Next, the hydraulic system for the working machine 1 will be described.

Figure 2:
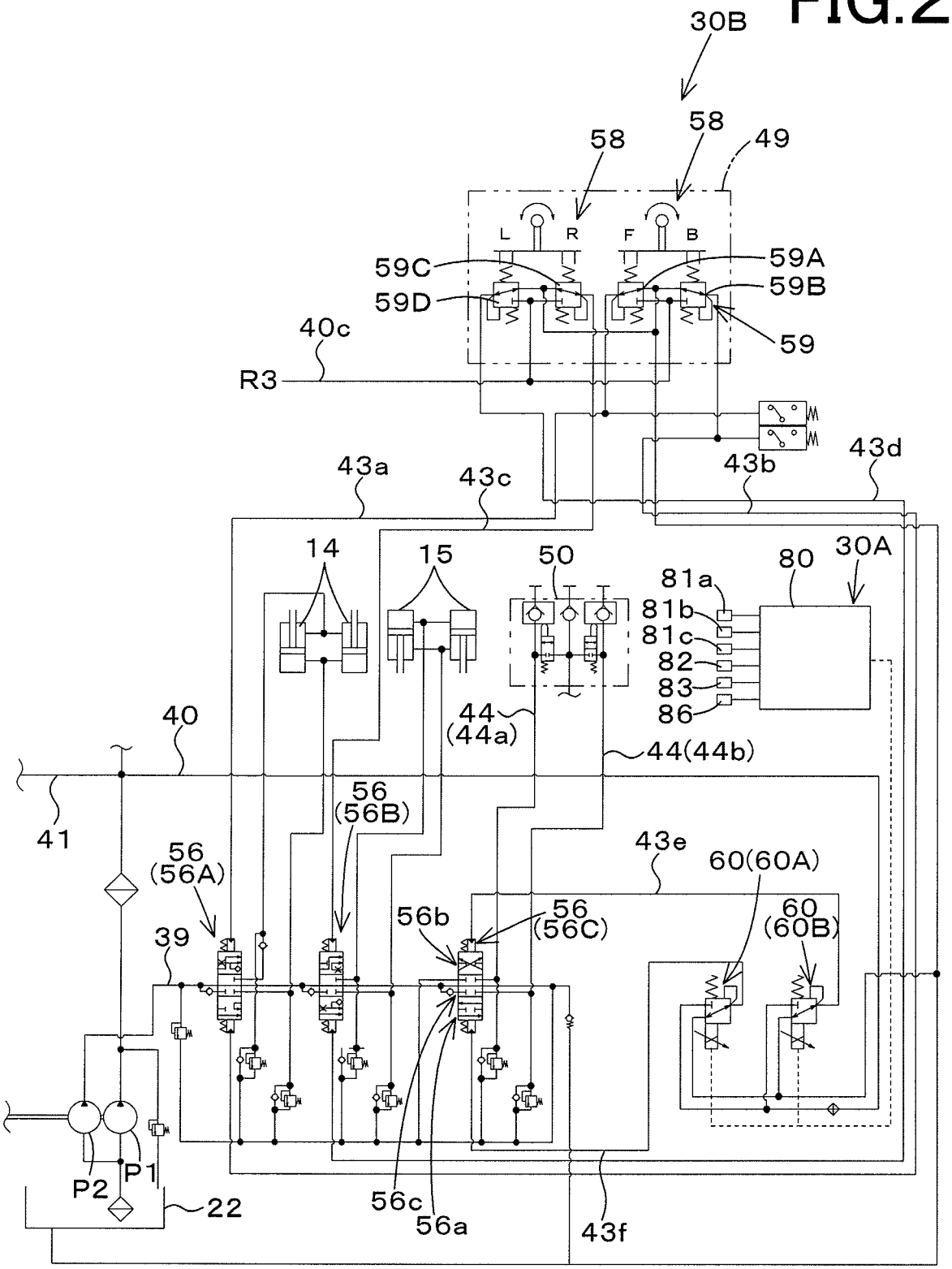
FIG. 2 is a view schematically illustrating an operating hydraulic system according to the first embodiment.

As shown in FIG. 1 and FIG. 2, the hydraulic system for the working machine 1 includes a traveling hydraulic system 30A and a operating hydraulic system 30B. Reference numerals "R1", "R2", and "R3" shown in FIG. 1 and FIG. 2 indicate the connecting destinations.

The traveling hydraulic system 30A will be described below.

As shown in FIG. 1, the traveling hydraulic system 30A is a system configured to drive the traveling hydraulic device, and includes a first hydraulic pump P1 and the traveling hydraulic device. The first hydraulic pump P1 is a pump configured to be driven by the power of the prime mover 32, and is constituted of a constant displacement type gear pump. The first hydraulic pump P1 is configured to output the hydraulic fluid (also referred to as a hydraulic fluid) stored in the tank 22.

In particular, the first hydraulic pump P1 mainly outputs the hydraulic fluid used for control. For convenience of the explanation, the tank 22 configured to store the hydraulic fluid may be referred to as an operation fluid tank. In addition, of the hydraulic fluid outputted from the first hydraulic pump P1, the hydraulic fluid used for control may be referred to as a pilot fluid (also referred to as a pilot fluid), and a pressure of the pilot fluid may be referred to as a pilot pressure.

The traveling hydraulic device includes a left traveling motor device (a first traveling motor device) 31L, a right traveling motor device (a second traveling motor device) 31R, and a hydraulic drive device 34.

The first traveling motor device 31L is a motor configured to transmit a motive power to the drive shaft of the traveling device 5, the traveling device 5 being disposed on the left side of the machine body 2. The second traveling motor device 31R is a motor configured to transmit a motive power to the drive shaft of the traveling device 5, the traveling device 5 being disposed on the right side of the machine body 2.

The first traveling motor device 31L has a braking device 35, a traveling hydraulic motor (HST motor) 36, a swash plate switching cylinder 37, and a traveling control valve (a hydraulic switching valve) 38A. The traveling hydraulic motor 36 is constituted of a variable displacement axial motor having a swash plate, and the traveling hydraulic motor 36 is a motor configured to change a vehicle speed (a revolution speed) to a first speed or to a second speed.

The swash plate switching cylinder 37 is constituted of a cylinder configured to be stretched and shortened to change an angle of the swash plate of the traveling hydraulic motor 36. The traveling control valve 38A is constituted of a two-position switching valve configured to stretch and shorten the swash plate switching cylinder 37 to one side of the swash plate switching cylinder 37 or to the other side and to be switched to the first position 38A and to the second position 38*b*. The switching operation of the traveling control valve 38A is carried out by the travel switching valve 33, the travel switching valve 33 being connected to the traveling control valve 38A and located on the upstream side of the traveling control valve 38A.

According to the first traveling motor device 31L mentioned above, when the traveling control valve 38A is in the first position 38A, the swash plate switching cylinder 37 is shortened, and thereby the traveling hydraulic motor 36 is set to the first speed. In addition, when the traveling control valve 38A is in the second position 38*b*, the swash plate switching cylinder 37 is stretched, and thereby the traveling hydraulic motor 36 is set to the second speed state.

Meanwhile, the second traveling motor device 31R also operates in the same manner as the first traveling motor device 31L. The configuration and operation of the second traveling motor device 31R are the same as those of the first traveling motor device 31L, and thus the explanation thereof is omitted.

In addition, the braking device 35 is a device configured to be switched between a braking state in which the traveling hydraulic motor 36 is braked and a released state in which the braking is released. The switching operation of the braking device 35 is carried out by the brake switching valve 51 through a fluid tube. The brake switching valve 51 is connected to the braking device 35. The brake switching valve 51 is constituted of a two-position switching valve having two positions and configured to be switched between the first position 51*a* and the second position 51*b*.

When the brake switching valve 51 is in the first position 51*a*, the hydraulic fluid inside the braking device 35 is released, and thereby the rotation of the rotary shaft of the traveling hydraulic motor 36 is controlled by the contact of a plurality of disks disposed inside the braking device 35, thereby the braking device 35 is set to be in the braking state. When the brake switching valve 51 is in the second position 51*b*, the plurality of disks are separated from each other to allow the rotary shaft of the traveling hydraulic motor 36 to revolve, thereby the braking device 35 is set to be in the released state.

The hydraulic drive device 34 is a device configured to drive the first traveling motor device 31L and the second traveling motor device 31R, and includes a drive circuit (a left drive circuit) 34L and a second drive (a right drive circuit) 34R, the drive circuit (the left drive circuit) 34L being configured to drive the first traveling motor device 31L, the second drive (a right drive circuit) 34R being configured to drive the second traveling motor device 31R.

The drive circuits 34L and 34R each have a traveling hydraulic pump (a HST pump) 53 and speed-changing fluid tubes 57*h* and 57*i*, respectively. Each of the speed-changing fluid tubes 57*h*, 57*i* is constituted of a circulating fluid tubes (a second fluid tube) configured to connect the traveling hydraulic pump 53 and the traveling hydraulic motor 36 to each other.

Meanwhile, the first traveling motor device 31L and the second traveling motor device 31R are provided with a flushing valve 23 and a relief valve 24 for flushing. The flushing valve 23 is switched by a higher one of the pressures of the speed-changing fluid tubes 57*h* and 57*i*, and thereby connects a lower one of the pressures of the speed-changing fluid tubes 57*h* and 57*i* to a relief fluid tube m for flushing. And, the flushing valve 23 outputs a part of the hydraulic fluid in the lower one of the speed-changing fluid tubes 57*h* and 57*i* through the relief fluid tube m for flushing and the relief valve 24 for flushing, and thereby charging the operation fluid to the lower one of the speed-changing fluid tubes 57*h* and 57*i*.

The traveling hydraulic pump 53 is constituted of a variable displacement axial pump having a swash plate, the variable displacement axial pump being configured to be driven by the motive power of the prime mover 32. The traveling hydraulic pump 53 has a forward pressure-receiving portion 53*a* and a backward pressure-receiving portion 53*b* to which the pilot pressure is applied. The angle of the swash plate is changed by the pilot pressure applied to the pressure-receiving portions 53*a* and 53*b*. By changing the angle of the swash plate, the output of the traveling hydraulic pump 53 (the outputting amount of the operation fluid) and the output direction of the operation fluid are changed.

The output of the traveling hydraulic pump 53 and the output direction of the hydraulic fluid are changed by a traveling operation device 52. The traveling operation device 52 is disposed around the operator seat 8. The travel control device 52 has a traveling operation member 54 and a plurality of operation valves 55, the traveling operation member 54 being constituted of a lever and the like, the plurality of operation valves 55 being connected to the traveling operation member 54. The traveling operation member 54 is supported so as to be tilted from the neutral position in an oblique direction between the forward direction, the backward direction, the leftward direction, and the rightward direction. By tilting the traveling operation member 54, the operation valve 55 Disposed on the lower portion of the traveling operation member 54.

The plurality of operation valves 55 include an operation valve 55A, an operation valve 55B, an operation valve 55C, and an operation valve 55D. Each of the forward-traveling operation valve 55A, the backward-traveling operation valve 55B, the rightward-turning operation valve 55C, and the leftward-turning operation valve 55D is constituted of a valve configured to set the pressure of the hydraulic fluid in accordance with the operation amount (an operation extent)

of the traveling operation member 54, the hydraulic fluid being to be supplied to the traveling hydraulic pump 53.

For example, the operation valve 55 increases the pressure (the pilot pressure) of the hydraulic fluid applied to the traveling hydraulic pump 53 as the operation amount of the traveling operation member 54 is increased, and the operation valve 55 reduces the pressure (the pilot pressure) of the hydraulic fluid applied to the traveling hydraulic pump 53 as the operation amount of the traveling operation member 54 is reduced.

When the traveling operation member 54 is tilted forward, the pilot pressure set by the forward-traveling operation valve 55A is applied to the forward pressure-receiving portion 53*a* of the left drive circuit 34L and to the forward pressure-receiving portion 53*a* of to the right drive circuit 34R through the fluid tube. In this manner, the output shaft of the traveling hydraulic motor 36 revolves forward (the forward revolving) at a speed proportional to the operation amount of the traveling operation member 54, and thereby the working machine 1 travels straight forward.

When the traveling operation member 54 is tilted backward, the pilot pressure set by the backward-traveling operation valve 55B is applied to the backward pressure-receiving portion 53*b* of the left drive circuit 34L and to the backward pressure-receiving portion 53*b* of the right drive circuit 34R through the fluid tube. In this manner, the output shaft of the traveling hydraulic motor 36 revolves in the reverse direction (the reverse revolving) at a speed proportional to the operating amount of the traveling operation member 54, and thereby the working machine 1 travels straight backward.

In addition, when the traveling operation member 54 is tilted to the right, the pilot pressure set by the rightward-turning operation valve 55C is applied to the forward pressure-receiving portion 53*a* of the left drive circuit 34L and to the backward pressure-receiving portion 53*b* of the right drive circuit 34R through the fluid tube. In this manner, the output shaft of the traveling hydraulic motor 36 on the left side revolves rotates in the forward direction, the output shaft of the traveling hydraulic motor 36 on the right side revolves in the reverse direction, and thereby the working machine 1 turns to the right.

Further, when the traveling operation member 54 is tilted to the left side, the pilot pressure set by the leftward-turning operation valve 55D is applied to the forward pressure-receiving portion 53*a* of the right drive circuit 34R and to the backward pressure-receiving portion 53*b* of the left drive circuit 34L through the fluid tube. In this manner, the output shaft of the traveling hydraulic motor 36 on the right side revolves rotates in the forward direction, the output shaft of the traveling hydraulic motor 36 on the left side revolves in the reverse direction, and thereby the working machine 1 turns to the left.

The operating hydraulic system 30B will be described below.

As shown in FIG. 2, the operating hydraulic system 30B is a system configured to operate the boom 10, the bucket 11, the auxiliary attachment, and the like, and includes a plurality of control valves 56A and an operating hydraulic pump (a second hydraulic pump) P2.

The second hydraulic pump P2 is a pump installed on a position different from that of the first hydraulic pump P1, and is constituted of a constant displacement gear pump. The second hydraulic pump P2 is configured to output the operation fluid stored in the operation fluid tank 22. In particular, the second hydraulic pump P2 outputs the operation fluid used for mainly activating the hydraulic actuators.

A main fluid tube (a fluid passage) 39 is disposed on the outputting side of the second hydraulic pump P2. The plurality of control valves 56 are connected to the main fluid tube 39. The plurality of control valves 56 are constituted of valves configured to switch, by the pilot pressure of the pilot fluid, the direction in which the operation fluid is supplied.

The plurality of control valves 56 controls the operating hydraulic actuator (the hydraulic cylinder, the hydraulic motor, and the like) configured to drive the hydraulic device such as the boom, the bucket, a hydraulic crusher, a hydraulic breaker, an angle broom, an earth auger, a pallet fork, a sweeper, a mower, a snow blower, and the like for example. The operating control valves (the plurality of control valves 56) and the operating hydraulic actuator each serve as the operating hydraulic apparatus.

As shown in FIG. 2, the plurality of control valves 56 includes a first control valve 56A, a second control valve 56B, and a third control valve 56C. The first control valve 56A is constituted of a valve configured to control the hydraulic cylinder (the boom cylinder) 14, the hydraulic cylinder 14 being configured to control the boom. The second control valve 56B is constituted of a valve configured to control the hydraulic cylinder (the bucket cylinder) 15, the hydraulic cylinder 15 being configured to control the bucket.

The third control valve 56C is constituted of a valve configured to control the operating hydraulic apparatus attached to the auxiliary attachment such as a hydraulic crusher, a hydraulic breaker, an angle broom, an earth auger, a pallet fork, a sweeper, a mower, a snow blower, and the like.

Each of the first control valve 56A and the second control valve 56B is constituted of a three-position switching valve of a direct-acting spool type that is configured to be actuated by a pilot fluid. The first control valve 56A and the second control valve 56B are configured to be switched by the pilot pressure between a neutral position, a first position other than the neutral position, and a second position other than the neutral position and the first position.

The boom cylinder 14 is connected to the first control valve 56A by a fluid tube, and the bucket cylinder 15 is connected to the second control valve 56B by a fluid tube.

The operations of the boom 10 and the bucket 11 are carried out by the working operation device 49, the working operation device 49 being disposed around the operator seat 8. As shown in FIG. 1 and FIG. 2, the working operation device 49 is connected to the fluid tube 40*c* of the outputting fluid tube 40, the outputting fluid tube 40 being connected to the outputting side of the first hydraulic pump P1. A working hydraulic lock valve 71 is connected to the branched fluid tube 40*c*. The working hydraulic lock valve 71 is a valve configured to be switched to change the opening aperture, and is constituted of a two-position switching valve having a first position (a blocking position) 71*a* and a second position (a supplying position) 71*b* and being configured to be switched between the first position 71*a* and the second position 71*b*.

In the case where the working hydraulic lock valve 71 is in the blocking position 71*a*, the operation fluid in the section 40*c* flows to the fluid tube 42 through the working hydraulic lock valve 71, and is outputted to the operation fluid tank 22. When the working hydraulic lock valve 71 is in the supplying position 71*b*, the operation fluid in the section 40*c* is supplied to the working operation device 49 through the working hydraulic lock valve 71. Thus, when the working hydraulic lock valve 71 is switched, it is possible to supply the operation fluid to the working operation device 49 or to block (stop) the supplying of the operation fluid.

The working operation device 49 has a working operation device 58 constituted of a lever or the like. The working operation device 58 is supported so as to be tilted from the neutral position in the front-to-rear direction, in the left-to-right direction, and in the oblique direction. When the operation member 58 is tilted, the tilting operation determines the pressure (the pilot pressure) of the operation fluid of the plurality of operation valves 59, the operation valves 59 being disposed on a lower portion of the working operation member.

The plurality of operation valves 59 include an operation valve 59A, an operation valve 59B, an operation valve 59C, and an operation valve 59D. The plurality of operation valves 59 and the plurality of control valves 56 are connected to each other by a plurality of working fluid tubes (the fourth fluid tubes) 43*a*, 43*b*, 43*c*, and 43*d*.

In particular, the operation valve 59A is connected to the first control valve 56A by the working fluid tube 43*a*. The operation valve 59B is connected to the first control valve 56A by the working fluid tube 43*b*. The operation valve 59C is connected to the first control valve 56B by the working fluid tube 43*c*. The operation valve 59D is connected to the first control valve 56B by the working fluid tube 43*d*. Each of the plurality of operation valves 59 is configured to set the pressure of the operation fluid, the operation fluid being outputted in accordance with the operation of the working operation device 58.

Specifically, when the working operation device 58 is tilted to the front side, the pilot pressure set by the downward-movement operation valve (the operation valve) 59A is applied to the pressure-receiving portion of the first control valve 56A, and thereby the boom cylinder 14 is shortened to move the boom 10 downward.

When the working operation device 58 is tilted to the rear side, the pilot pressure set by the upward-movement operation valve (the operation valve) 59B is applied to the pressure-receiving portion of the first control valve 56A, and thereby the boom cylinder 14 is stretched to move the boom 10 upward.

When the working operation device 58 is tilted to the right side, the pilot pressure set by the bucket-dumping operation valve (the operation valve) 59C is applied to the pressure-receiving portion of the second control valve 56B, and thereby the bucket cylinder 15 is stretched to move the bucket 11 in the dumping operation.

When the working operation device 58 is tilted to the left side, the pilot pressure set by the bucket-shoveling operation valve (the operation valve) 59D is applied to the pressure-receiving portion of the second control valve 56B, and thereby the bucket cylinder 15 is shortened to move the bucket 11 in the shoveling operation.

The third control valve 56C is constituted of a three-position switching valve of a direct-acting spool type that is configured to be actuated by a pilot fluid. The third control valve 56C is configured to be switched by the pilot pressure between a first position 56*a*, a second position 56*b*, and a third position (a neutral position) 56*c*. That is, the third control valve 56C is switched between the first position 56*a*, the second position 56*b*, and the third position 56*c*, and thereby controls the direction of, the flow rate of, and the pressure of the operation fluid flowing toward the hydraulic apparatus of the auxiliary attachment.

A supplying-outputting fluid tube 44 is connected to the third control valve 56C. One end of the supplying-outputting fluid tube 44 is connected to the supplying-outputting port of the third control valve 56C, and an intermediate portion of the supplying-outputting fluid tube 44 is connected to the connecting member 50, and the other end of the supplying-outputting fluid tube 44 is connected to the hydraulic apparatus of the auxiliary attachment. The supplying-outputting fluid tube 44 is constituted of a first pipe member, a second pipe member, and the like described above.

Specifically, the supplying-outputting fluid tube 44 includes a first supplying-outputting fluid tube 44*a* configured to connect the first supplying-outputting port of the third control valve 56C and the first port of the connecting member 50 to each other. In addition, the supplying-outputting fluid tube 44 includes a second supplying-outputting fluid tube 44*b* configured to connect the second supplying-outputting port of the third control valve 56C and the second port of the connecting member 50 to each other. That is, when the third control valve 56C is operated, the operation fluid flows from the third control valve 56C toward the first supplying-outputting fluid tube 44*a* and flows from the third control valve 56C toward the second supplying-outputting fluid tube 44*b*.

The third control valve 56C is operated by a plurality of control valves 60. The plurality of control valves 60 are also one of the working hydraulic devices, and includes a first proportional valve 60A and a second proportional valve 60B. Each of the first proportional valve 60A and the second proportional valve 60B is constituted of an electromagnetic valve whose opening aperture is changed by the electromagnetic excitation or the like. An outputting fluid tube 40 is connected to the first proportional valve 60A and to the second proportional valve 60B. The pressure-receiving portion of the third control valve 56C and the proportional valves 60 (the first proportional valve 60A and the second proportional valve 60B) are connected by the working fluid tubes (the fourth fluid tubes) 43*e* and 43*f*. The control of the proportional valves 60 (the first proportional valve 60A and the second proportional valve 60B) is carried out by the control device 80.

A switch 86 that is one of the working operation members is connected to the control device 80. The operating amount (for example, the sliding amount, the swinging amount, and the like) of the switch 86 is inputted to the control device 80. The switch 86 is, for example, constituted of a swingable switch of the seesaw type (a seesaw switch), a slidable switch of the slide type (a slide switch), a pushable switch of the push type (a push switch), or the like. When the switch 86 is operated, the control device 80 outputs a control signal for magnetically exciting the first proportional valve 60A or the second proportional valve 60B in accordance with the operating direction of and the operating amount of the switch 86.

In this manner, the opening aperture of the first proportional valve 60A or the second proportional valve 60B is set, and thereby the third control valve 56C is switched to the first position 56*a* or to the second position 56*b*. Thus, by manipulating the switch 86, the hydraulic apparatus of the auxiliary attachment is operated.

In the traveling hydraulic system 30A, it is possible to reduce the flow rate (the pressure) of the operation fluid on the primary side of each of the plurality of operation valves 55. The reduction of the operation fluid on the primary side of each of the plurality of operation valves 55 will be described in detail. As shown in FIG. 1, the plurality of operation valves 55 and the first hydraulic pump P1 are connected to each other by an outputting fluid tube (a first fluid tube) 40. In addition, the outputting fluid tube 40 is branched, and the travel switching valve 33, the brake switching valve 51, and the working hydraulic lock valve 71 are connected to the branched fluid tube after the branching portion.

The travel switching valve 33, the brake switching valve 51, and a first working valve 72 other than the working hydraulic lock valve 71 are connected to an intermediate portion of the outputting fluid tube 40. The first working valve 72 has a first port 72A, a second port 72B, and a third port 72C.

The first port 72A is connected to a section 40*a* of the outputting fluid tube 40, the section 40*a* being connected to the first hydraulic pump P1. A fluid tube 42 is connected to the second port 72B, the fluid tube 42 being configured to output the operation fluid. The third port 72C is connected to a section 40*b* of the outputting fluid tube 40, the section 40*b* being connected to the plurality of operation valves 55. Meanwhile, the travel switching valve 33, the brake switching valve 51, and the working hydraulic lock valve 71 are also connected to the fluid tube 42.

The first working valve 72 is a valve configured to be switched to change the opening aperture, and is constituted of a two-position switching valve having a first position (a blocking position) 72*a* and a second position (a supplying position) 72*b* and being configured to be switched between the first position 72*a* and the second position 72*b*. When the first working valve 72 is in the blocking position 72*a*, the operation fluid in the section 40*b* flows toward the fluid tube 42 through the second port 72B and the third port 72C of the first working valve 72, and is outputted to the operation fluid tank 22.

When the first working valve 72 is in the supplying position 72*b*, the operation fluid in the section 40*a* flows to the section 40*b* through the first port 72A of and the third port 72C of the first working valve 72, and is supplied to the plurality of operation valves 55.

Thus, when the first working valve 72 is switched, the operation fluid is supplied to the plurality of operation valves 55 or blocks (stops) the supplying of the operation fluid. The control of the first working valve 72 is carried out by the control device 80 connected to the first working valve 72.

In the outputting fluid tube 40*a*, an outputting fluid tube (a first outputting fluid tube) 73 is connected to a section 40*b* between the first working valve 72 and the plurality of operation valves 55, the outputting fluid tube 73 being configured to output the operation fluid. The throttling portion 75 is disposed on the upstream side of the connecting portion between the first outputting fluid tube 73 and the section 40*b* (on the side of the first working valve 72), that is, on the downstream side of the first working valve 72, the throttling portion 75 being configured to reduce the flow rate of the operation fluid.

A second working valve 74 is connected to an intermediate portion of the first outputting fluid tube 73. The second working valve 74 is a valve configured to change the opening aperture thereof, and is constituted of a variable relief valve. The control of the second working valve (a variable relief valve) 74 is carried out by the control device 80 connected to the second working valve 74.

The control by the control device 80 will be described below in detail.

A first switch 81*a* and a second switch 81*b* are connected to the control device 80. Each of the first switch 81*a* and the second switch 81*b* is constituted of a switch configured to be turned ON/OFF. The first switch 81*a* and the second switch 81*b* are disposed in the vicinity of the operator seat 8, and is configured to be operated by, for example, an operator.

When the first switch 81*a* is turned ON, the control device 80 outputs a control signal for magnetizing the solenoid of the first working valve 72, and thereby sets the first working valve 72 to the supplying position 72*b*. When the first switch 81*a* is turned OFF, the control device 80 outputs a control signal for demagnetizing the solenoid of the first working valve 72, and thereby sets the first working valve 72 to the blocking position 72*b*.

When the second switch 81*b* is turned ON, the control device 80 outputs a control signal for magnetizing the solenoid of the second working valve 74, and thereby reduces the set pressure of the second working valve 74. In particular, under the state where the first working valve 72 is in the supplying position 72*b* and the first hydraulic pump P1 is operating at a rated power (hereinafter referred to as "under the normal operation"), the set pressure of the second working valve 74 is reduced so that the operation fluid in the section 40*b* can be outputted through the first outputting fluid tube 73.

In other words, the set pressure of the second working valve 74 is reduced to be lower than the outputting pressure at the rated operation in the first hydraulic pump P1. Meanwhile, when the second switch 81*b* is turned ON, the control device 80 may minimize the set pressure of the second working valve 74.

When the second switch 81*b* is turned OFF, the control device 80 outputs a control signal for demagnetizing the solenoid of the second working valve 74, and thereby fixedly sets the set pressure of the second working valve 74 to the set value preliminarily determined. For example, the set value of the second working valve 74 is set to be higher than the pressure of the operation fluid of the outputting fluid tube 40 at the rated operation of the first hydraulic pump P1.

That is, the control device 80 fixes the set value of the second working valve 74 so that the operation fluid in the section 40*b* is not allowed to be outputted through the first outputting fluid tube 73 at the normal operation.

Thus, when the second switch (a warm-up switch) 81*b* is turned on, the operation fluid of the outputting fluid tube 40 (the operation fluid on the primary side supplied to the traveling operation device 52) is outputted to the operation fluid tank 22 through the first outputting fluid tube 73 and the second working valve 74, and thereby the traveling hydraulic system is warmed up.

In the above-described embodiments, the warming-up is carried out when both of the first switch 81*a* and the second switch 81*b* are turned ON. However, the first switch 81*a* and the second switch 81*b* may be alternatively shared. For example, when the second switch 81*b* is turned on, the control device 80 may switch the first working valve 72 to the supplying position 72*b*, and may lower the set value of the second working valve 74.

Meanwhile, the measuring device 82 may be connected to the control device 80, the measuring device 82 being configured to measure an outside air temperature or a temperature of the operation fluid (a fluid temperature), and thereby the warming-up may be carried out based on the outside air temperature or the fluid temperature measured by the measuring device 82. For example, under the state where the fluid temperature measured by the measuring device 82 is equal to or lower than a threshold temperature (for example, −10° C.), that is, the low temperature, and the viscosity of the operation fluid is high, the control device 80 outputs a control signal to the second working valve 74, and thereby lower the set pressure of the second working valve 74.

In this manner, it is possible to carry out the warming-up in which the operation fluid of the outputting fluid tube 40 is returned to the operation fluid tank 22 and the like through the first outputting fluid tube 73 under the condition that the fluid temperature is low and the viscosity is high.

In addition, when the speed (the vehicle speed) of the working machine 1 is required to be limited or when the load of the engine becomes large, the set pressure of the second working valve 74 may be reduced, and thereby the pressure of the operation fluid supplied to the plurality of operation valves 55 may be lowered. For example, a third switch (a vehicle-speed limiting switch) 81*c* is connected to the control device 80, the third switch 81*c* being switchable between ON and OFF. Then, the control device 80 reduces the set pressure of the second working valve 74 when the third switch 81*c* is turned ON, and the set pressure of the second working valve 74 is not reduced when the third switch 81*c* is turned OFF.

In addition, the measuring device 83 is connected to the control device 80, the measuring device 83 being configured to detect the load of the engine. When the load measured by the measuring device 83 is equal to or more than a threshold value, the control device 80 lowers the set pressure of the second working valve 74. And, when the load is less than the threshold value, the control device 80 does not lower the set pressure of the second working valve 74.

Figure 3A:
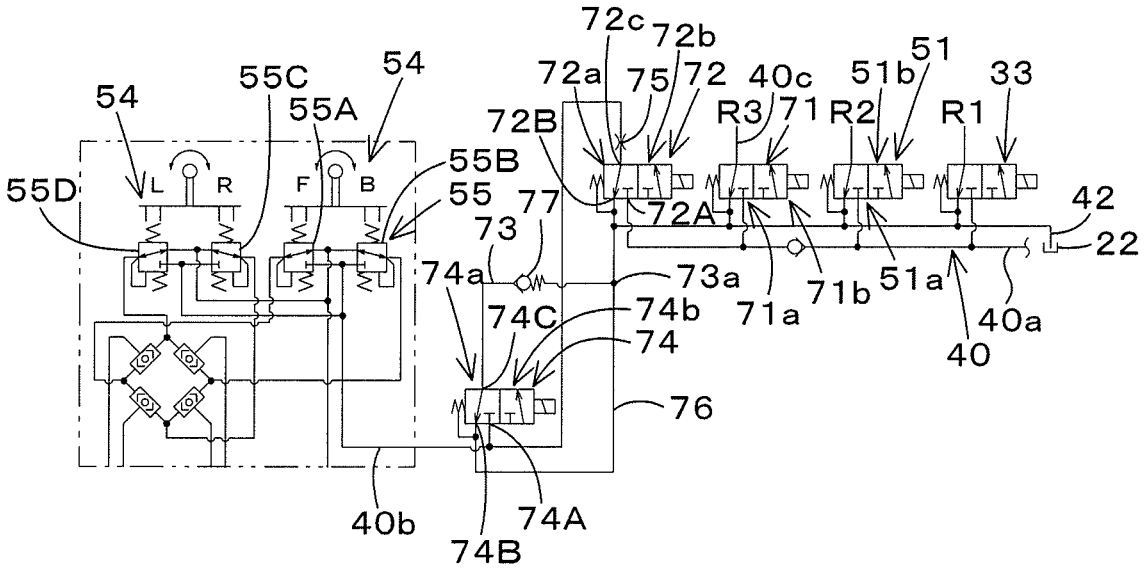
FIG. 3A is a view illustrating a first modified example of the hydraulic system according to the first embodiment.

FIG. 3A shows a first modified example of the hydraulic system for the working machine 1. Note that the control device 80 is omitted in FIG. 3A.

As shown in FIG. 3A, the second working valve 74 has a first port 74A, a second port 74B, and a third port 74C. An intermediate portion of the first outputting fluid tube 73 is connected to the first port 74A and to the third port 74C. The first outputting fluid tube 73 is connected to the second outputting fluid tube 76, the second outputting fluid tube 76 connecting the first working valve 72 and the second working valve 74 to each other.

More specifically, the second outputting fluid tube 76 connects the second port 72B of the first working valve 72 to the second port 74B of the second working valve 74 to each other, and connects end portions of the first outputting fluid tube 73 to each other. The second outputting fluid tube 76 is connected to the fluid tube 42. Meanwhile, the fluid tube 42 may be included in the second outputting fluid tube 76.

In addition, the check valve 77 is connected to the first outputting fluid tube 73 between the third port 74C and the connecting portion 73*a* connected to the second outputting fluid tube 76 in the first outputting fluid tube 73. The check valve 77 allows the operation fluid to flow from the section 40*b* of the outputting fluid tube 40 toward the second outputting fluid tube 76 and blocks the operation fluid from flowing from the second outputting fluid tube 76 to the section 40*b*.

The second working valve 74 is a valve configured to be switched to change an opening aperture of the second working valve 74, and is constituted of a two-position switching valve having a first position 74*a* and a second position 74*b* and being configured to be switched between the first position 74*a* and the second position 74*b*. The switching of the second working valve 74 is carried out by the control device 80. For example, when the second switch (the warm-up switch) 81*b* is turned OFF, the control device 80 demagnetizes the solenoid of the second working valve 74 to hold the second working valve 74 at the first position (the preventing position) 74*a*. When the second working valve 74 is in the first position 74*a*, the operation fluid in the section 40*b* does not flow to the second outputting fluid tube 76 but flow toward the plurality of operation valves 55 through the first outputting fluid tube 73.

For example, when the second switch 81*b* is turned ON, the control device 80 magnetizes the solenoid of the second working valve 74, and thereby switches the second working valve 74 to the second position (the allowing position) 74*b*. When the second working valve 74 is in the second position 74*b*, the operation fluid in the section 40*a* flows to the outputting fluid tube 73 and the check valve 77 through the first port 72A and the third port 72C of the second working valve 74, and then is outputted to the fluid tube 42 through the second outputting fluid tube 76.

Thus, by switching the second working valve 74, the operation fluid is supplied to the plurality of operation valves 55 or the warming-up is carried out. Also in the first modification, the second working valve 74 may be switched based on the outside air temperature or on the fluid temperature as described above.

In the hydraulic system shown in FIG. 3A, the second port 72B of the first working valve 72 and the second port 74B of the second working valve 74 are connected each other by the second outputting fluid tube 96. Instead of that, the second port 72B of the first working valve 72 and the second port 74B of the second working valve 74 may be separately connected to the outputting fluid tube.

Figure 3B:
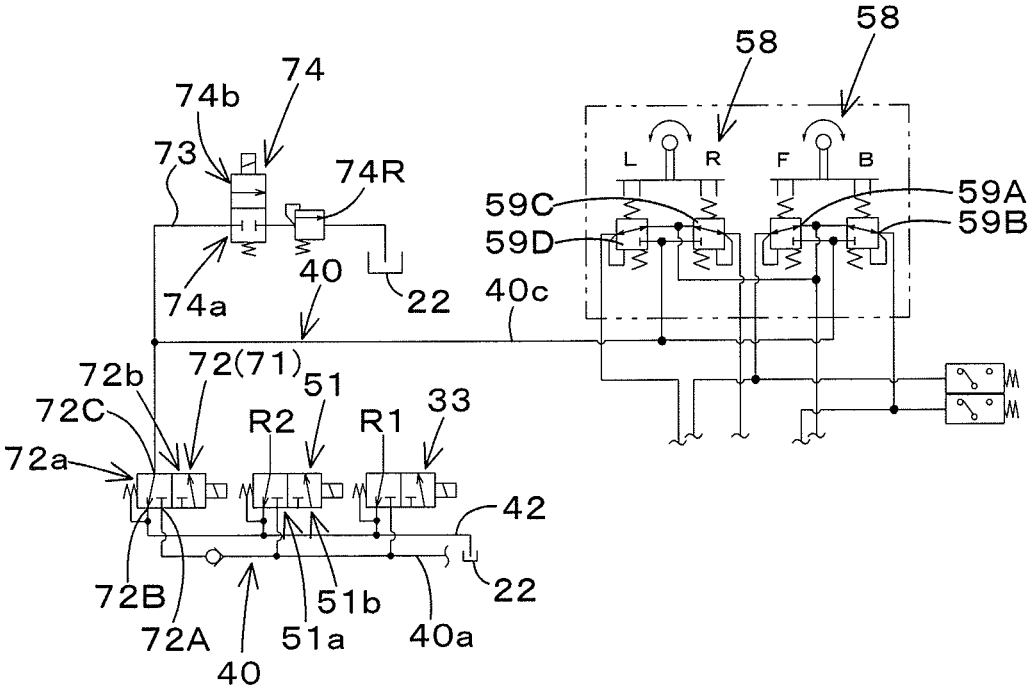
FIG. 3B is a view illustrating a second modified example of the hydraulic system according to the first embodiment.

FIG. 3B shows a second modified example of the hydraulic system for the working machine 1. Note that the control device 80 is omitted in FIG. 3B.

In the second modified example, the first working valve 72 is employed as the working hydraulic lock valve 71 described above, and the first outputting fluid tube 73 having the second working valve 74 is connected to the section 40*c*. The second working valve 74 is constituted of a two-position switching valve having a first position 74*a* and a second position 74*b* and is configured to be switched between the first position 74*a* and the second position 74*b*.

In the second modified example, the first position 74A is a preventing position for preventing the operation fluid in the first outputting fluid tube 73 from being outputted, and the second position 74B is an allowing position for allowing the operation fluid in the first outputting fluid tube 73 to be outputted. The second working valve 74 is connected to the control device 80.

For example, when the second switch 81*b* is turned OFF, the control device 80 demagnetizes the solenoid of the second working valve 74, and thereby holds the second working valve 74 at the preventing position 74*a*. When the second switch 81*b* is turned ON, the control device 80 magnetizes the solenoid of the second working valve 74, and thereby switches the second working valve 74 to the allowing position 74*b*.

Meanwhile, in addition to the two-position switching valve, the second working valve 74 may have a relief valve 74R. Also in the second modified example, the second working valve 74 may be switched based on the outside air temperature or the fluid temperature as described above.

Thus, according to the second modified example, when the second switch 81*b* is turned on, the operation fluid on the primary side supplied to the working operation device 49 is outputted to the operation fluid tank 22 through the first outputting fluid tube 73 and the second working valve 74, and thereby the operating hydraulic system is warmed up.

The second working valve 74 is constituted of a two-position switching valve in the second modified example. However, the second working valve 74 may be constituted of a variable relief valve or the like as described above, and the hydraulic circuit shown in FIG. 3A may be applied to the fluid tube 40*c* of the working operation device 49.

In addition, the second working valve 74 constituted of the two-position switching valve shown in FIG. 3B may be employed as the second working valve shown in FIG. 1, and the second working valve 74 and the like shown in FIG. 3B may be applied to the traveling hydraulic system.

Second Embodiment

Figure 4:
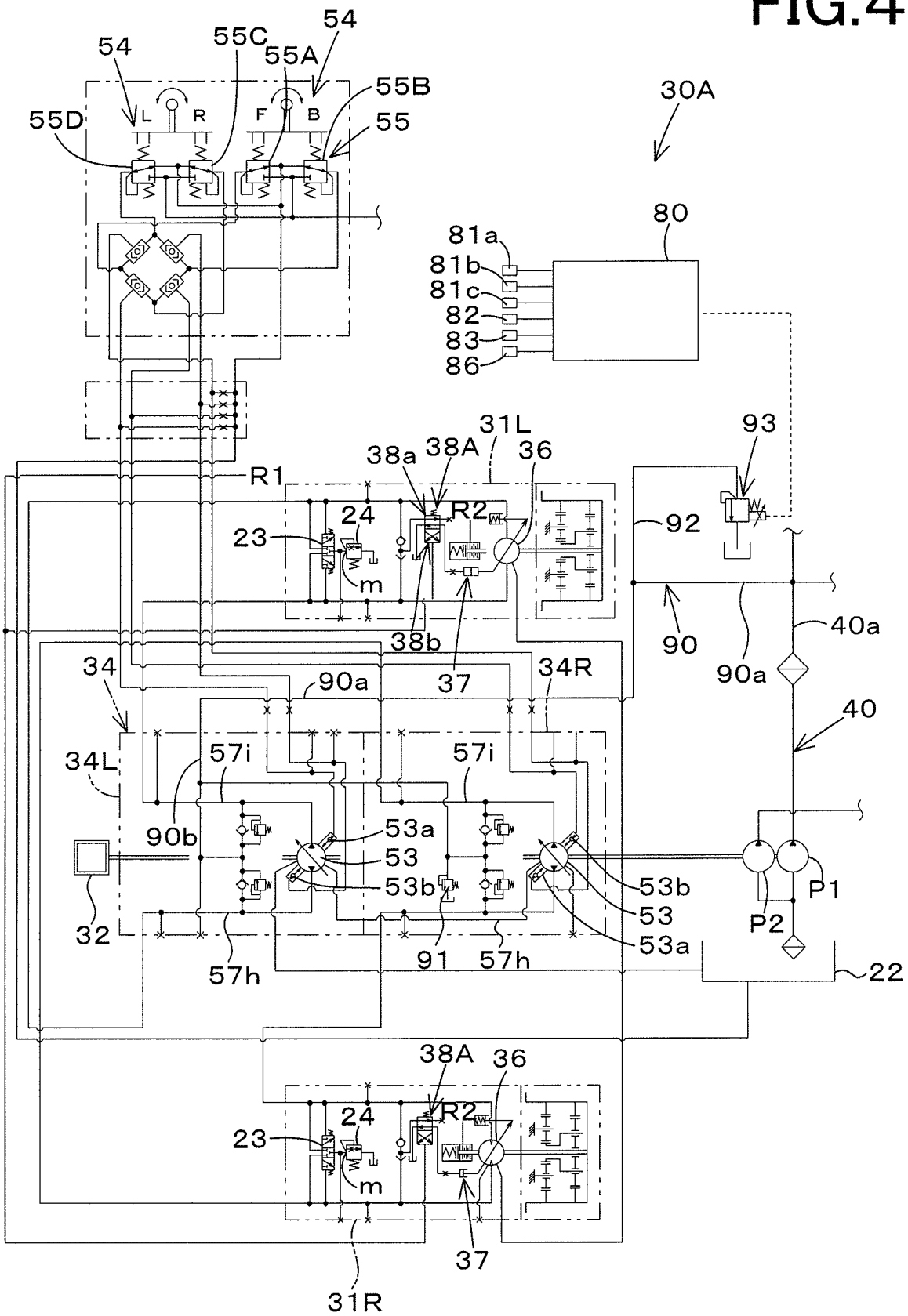
FIG. 4 is a view illustrating a traveling hydraulic system according to a second embodiment of the present invention.

FIG. 4 shows a hydraulic system according to a second embodiment of the present invention. In the second embodiment, the configurations different from those described in the first embodiment will be mainly described. In FIG. 4, the brake switching valve 51, the working hydraulic lock valve 71, the first working valve 72, and the control device 80 are omitted.

As shown in FIG. 4, the traveling hydraulic system has a charging fluid tube (the third fluid tube) 90 connected to the outputting fluid tube 40. The charging fluid tube 90 is connected to the circulating fluid tubes (the second fluid tubes) 57*h* and 57*i*, and is constituted of a fluid tube configured to supply the operation fluid outputted from the first hydraulic pump P1. For convenience of the explanation, the first hydraulic pump P1 is referred to as a charging hydraulic pump P1.

In the second embodiment, the first hydraulic pump P1 works as both of a hydraulic pump configured to output the pilot fluid and a charging hydraulic pump configured to fill the operation fluid to the circulating fluid tubes 57*h* and 57*i*. However, the charging hydraulic pump may be constituted of a single hydraulic pump or may be constituted of a hydraulic pump other than the hydraulic pump configured to output the pilot fluid.

The charging fluid tube 90 has a first charging fluid tube 90*a* and a second charging fluid tube 90*b*. The first charging fluid tube 90*a* is constituted of a fluid tube extending from the connecting portion of the outputting fluid tube 40 to the hydraulic drive device 34. The second charging fluid tube 90*b* is constituted of a fluid tube disposed inside the inside of the hydraulic drive device 34 (the left drive circuit 34L and the right drive circuit 34R) and connected to the circulating fluid tubes 57*h* and 57*i*. A relief valve 91 is disposed on the second charging fluid tube 90*b*, the relief valve 91 being configured to relieve the operation fluid due to fluctuations of the pressures in the circulating fluid tubes 57*h*, 57*i* and the like.

A third outputting fluid tube 92 is connected to an intermediate portion of the charging fluid tube 90, that is, to the first charging fluid tube 90*a*. A third working valve 93 is connected to an intermediate portion of the third outputting fluid tube 92. The third working valve 93 is a valve configured to change an opening aperture of the third working valve 93, and is constituted of a variable relief valve. When an angle of the swash plate of the traveling hydraulic pump 53 is restricted, the set pressure of the third working valve 93 is lowered.

For example, the set pressure of the third working valve 93 is lowered by the control device 80 as described above when the first working valve 72 is in the blocking position 72*a* and the operation fluid is not supplied to the traveling operation device 52 (in the case of the hydraulic locking), when the vehicle speed is restricted (in the creeping mode), when the pressure of operation fluid supplied to the traveling operation device 52 is restricted to prevent the engine from being stalled (in the anti-stall mode), when the braking device 35 brakes the traveling hydraulic motor 36 (In the case of the braking mode), and the like. Detection of each of the hydraulic locking, the creeping mode, the anti-stall mode, and the braking mode is carried out by various devices connected to the control device 80.

For example, the control device 80 detects the hydraulic locking when the first switch 81*a* is turned ON, the control device 80 detects the anti-stall mode when a signal for controlling the anti-stalling is inputted by the switch, and the control device 80 detects the creeping mode when the third switch 81*c* is turned ON. In addition, the control device 80 judges the braking mode based on whether the control device 80 outputs a control signal for switching the brake switching valve 51 to the first position 51*a* or not.

When the control device 80 detects any one of the hydraulic locking, the anti-stall mode, the creeping mode, and the braking mode, the control device 80 outputs a control signal for magnetizing the solenoid of the third working valve 93, and thereby the set pressure of the third working valve 93 is lowered. That is, by lowering the set pressure of the third working valve 93, the operation fluid in the charging fluid tube 90 is outputted from the third outputting fluid tube 92 to the operation fluid tank 22, and thereby an amount of the operation fluid filled into the circulating fluid tubes 57*h* and 57*i* is decreased.

On the other hand, when the control device 80 does not detect the hydraulic locking, the anti-stall mode, the creeping mode, and the braking mode, the control device 80 outputs a control signal for demagnetizing the solenoid of the third working valve 93, and thereby fixes the set pressure of the third working valve 93 to a predetermined set value. The set value of the third working valve 93 is set to be higher than the pressure of the operation fluid of the outputting fluid tube 40 at the rated power of the first hydraulic pump P1, for example.

As described above, in restricting the angle of the swash plate of the traveling hydraulic pump 53, the amount of operation fluid to be filled into the circulating fluid tubes 57*h* and 57*i* is reduced by the third working valve 93 and the third outputting fluid tube 92. Thus, the power loss of the first hydraulic pump P1 is reduced in this manner.

Figure 5A:
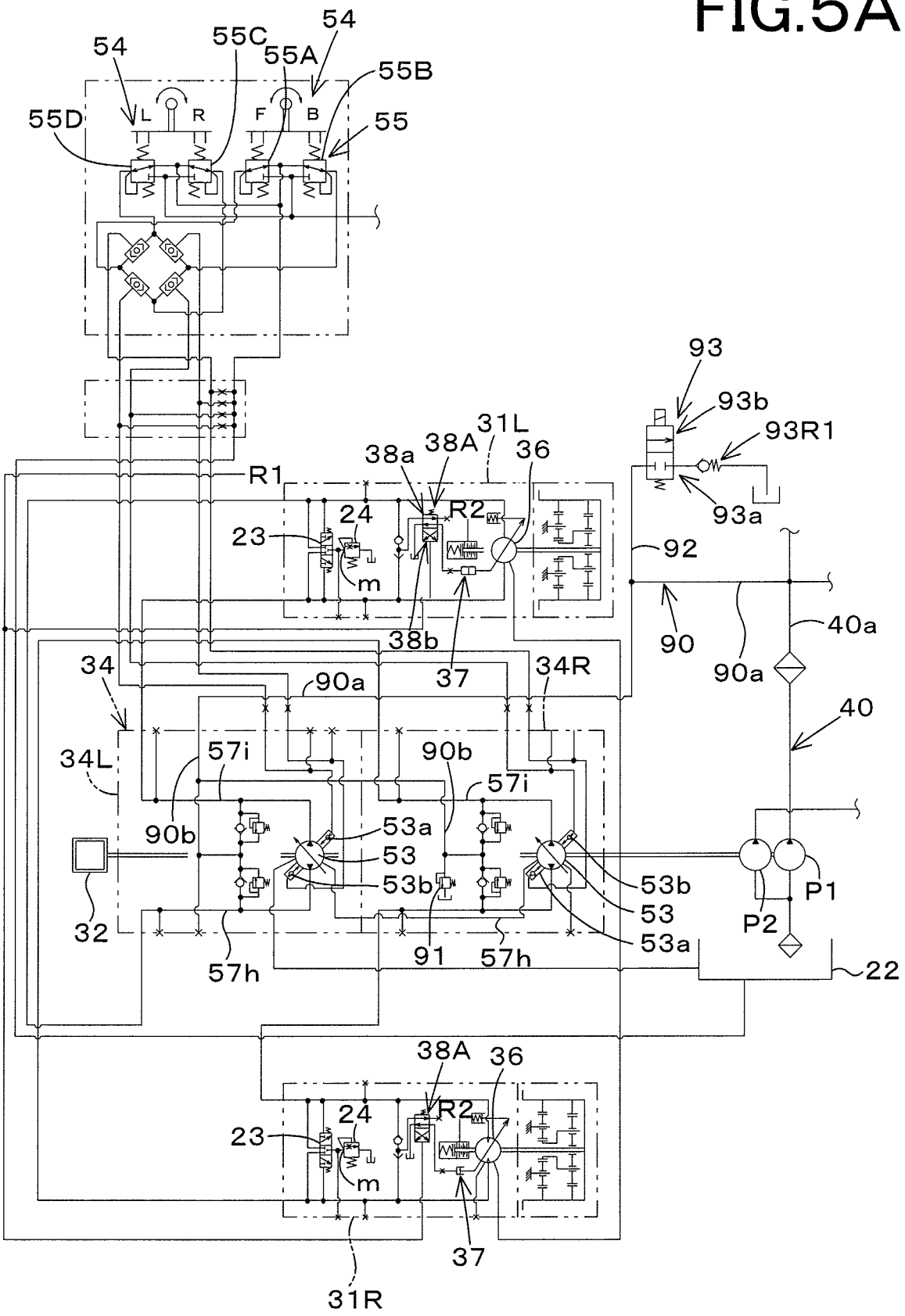
FIG. 5A is a view illustrating a first modified example of the traveling hydraulic system according to the second embodiment.
Figure 5B:
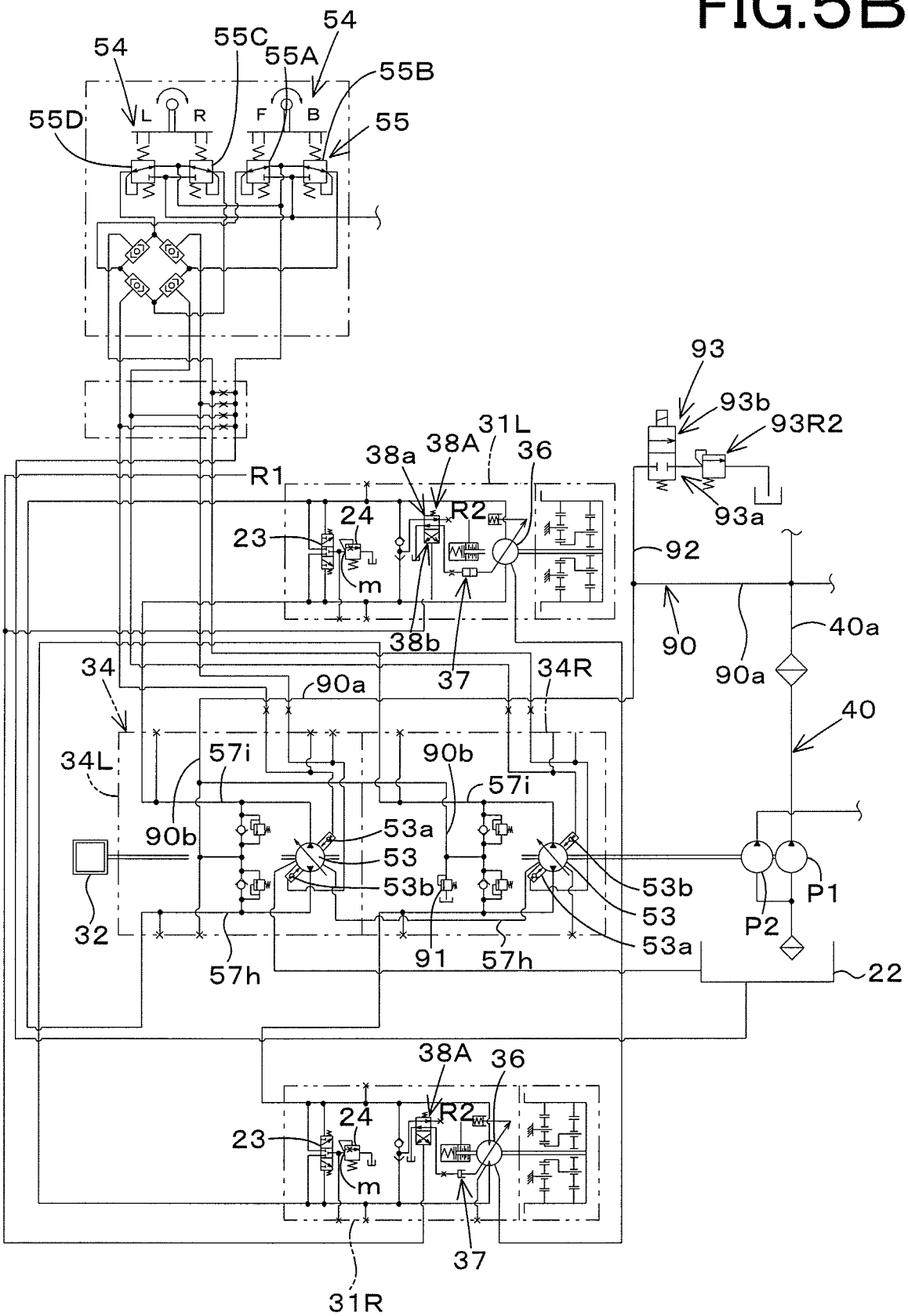
FIG. 5B is a view illustrating a second modified example of the traveling hydraulic system according to the second embodiment.

FIG. 5A and FIG. 5B show a first modified example and a second modified example of the hydraulic system according to the second embodiment. In the first modified example of FIG. 5A, the third working valve 93 is constituted of a two-position switching valve configured to be switched between the first position 93*a* and the second position 93*b*. The first position 93*a* is a preventing position for preventing the operation fluid in the third drain fluid tube 92 from being outputted, and the second position 93*b* is an allowing position for allowing the operation fluid in the third drain fluid tube 92 to be outputted.

In the case where the angle of the swash plate of the traveling hydraulic pump 53 is not restricted, the control device 80 demagnetizes the solenoid of the third working valve 93, and thereby holds the third working valve 93 to the preventing position 93*a*. When the angle of the swash plate of the traveling hydraulic pump 53 is restricted, the control device 80 magnetizes the solenoid of the third working valve 93, and thereby switches the third working valve 93 to the allowing position 93*b*. Meanwhile, the third working valve 93 may have a check valve 93R1 in addition to the two-position switching valve as shown in FIG. 5A.

In addition, as shown in FIG. 5B, the third working valve 93 may have a relief valve 93R2 in addition to the two-position switching valve.

Further, in the second embodiment, the first outputting fluid tube 73 may be provided with the second working valve 74, and the first outputting fluid tube 73 may be applied also to a hydraulic system without the second working valve 74.

Third Embodiment

Figure 6A:
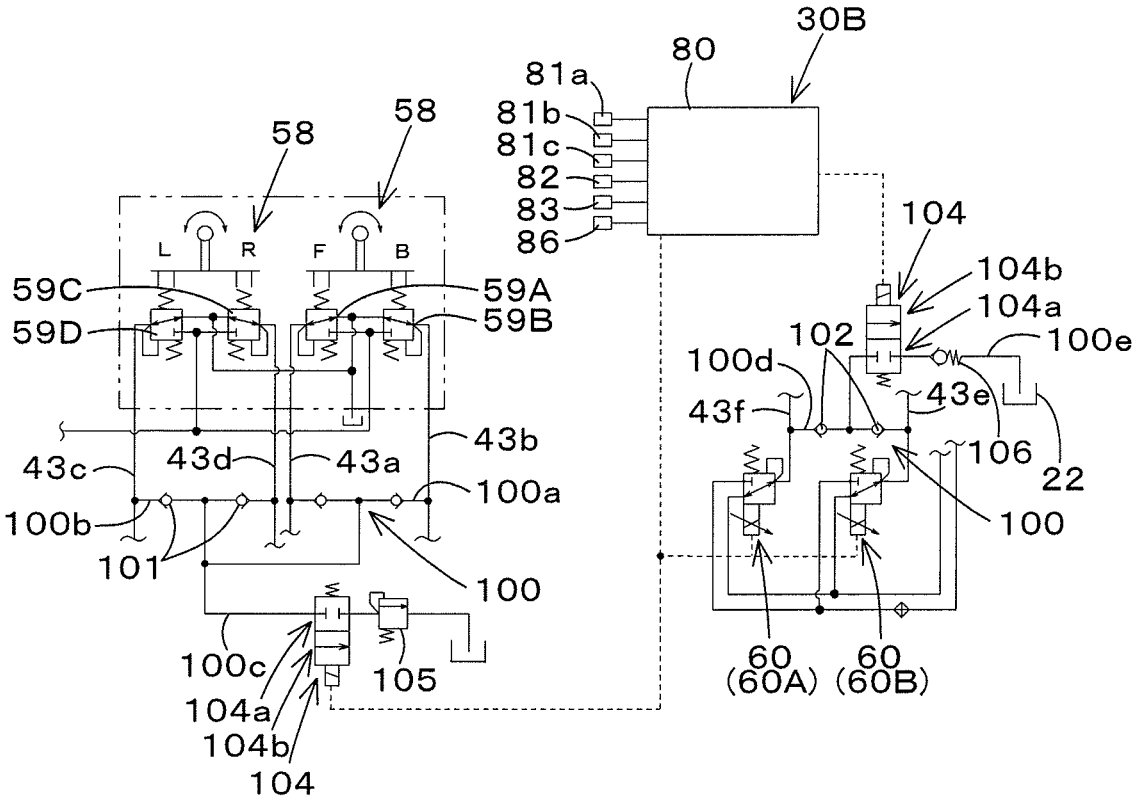
FIG. 6A is a view illustrating a part of an operating hydraulic system according to a third embodiment of the present invention.

FIG. 6A shows a hydraulic system according to the third embodiment. In the third embodiment, a configuration different from those of the first embodiment and the second embodiment will mainly be described below.

The third embodiment shown in FIG. 6A is an embodiment in which the operating hydraulic system is modified in comparison with the embodiments described above. The configuration of the operating hydraulic system other than those shown in FIG. 6A is the same as those shown in FIG. 2.

The operating hydraulic system shown in FIG. 6A has a fourth outputting fluid tube 100 connected to a plurality of working fluid tubes (the fourth fluid tubes) 43*a*, 43*b*, 43*c*, 43*d*, 43*e*, and 43*f*.

The fourth outputting fluid tube 100 has a fluid tube 100*a*, a fluid tube 100*b*, and a fluid tube 100*c*. The fluid tube 100*a* is a fluid tube connecting the working fluid tube 43*a* and the working fluid tube 43*b* to each other. The fluid tube 100*b* is a fluid tube connecting the working fluid tube 43*c* and the working fluid tube 43*d* to each other. The fluid tube 100*d* is a fluid tube connecting the fluid tube 100*a* and the fluid tube 100*b* to each other and being configured to output the operation fluid.

A check valve 101 is connected to the check valve 101*a* and the check valve 101*b*. The check valve 101 is configured to allow the operation fluid of the working fluid tubes 43*a*, 43*b*, 43*c*, and 43*d* to flow toward the fluid tube 100*c* and to block the operation fluid of the fluid tube 100*c* from flowing toward the working fluid tubes 43*a*, 43*b*, 43*c*, and 43*d*.

In addition, the fourth outputting fluid tube 100 has a fluid tube 100*d* and a fluid tube 100*e*. The fluid tube 100*d* is a fluid tube connecting the working fluid tube 43*e* and the working fluid tube 43*f* to each other. The fluid tube 100*e* is a fluid tube configured to output the operation fluid of the fluid tube 100*d*. A check valve 102 is connected to the fluid tube 100*e*. The check valve 102 is configured to allow the operation fluid of the working fluid tubes 43*e* and 43*f* to flow toward the fluid tube 100*e* and to block the operation fluid of the fluid tube 100*e* from flowing toward the working fluid tubes 43*e* and 43*f*.

A plurality of fourth working valves 104 are connected to the fourth outputting fluid tube 100. The plurality of fourth working valves 104 are constituted of two-position switching valves configured to be switched between the first position 104*a* and the second position 104*b*, specifically valves configured to be switched to change opening apertures of the valves. Switching of the fourth working valve 104 is carried out by the control device 80.

For example, when the second switch 81*b* is OFF, the control device 80 demagnetizes the solenoid of the fourth working valve 104 to maintain the fourth working valve 104 in the first position (a preventing position) 104*a*. When the fourth working valve 104 is in the first position 104*a*, the operation fluid in the working fluid tubes 43*a*, 43*b*, 43*c*, 43*d*, 43*e*, and 43*f* are not outputted from the plurality of fourth working valves 104 (the operation fluid is prevented from being outputted from the fourth outputting fluid tube 100 to the operation fluid tank 22), and the operation fluid are supplied to each of the control valves 56A, 56B, 56C, 60A, and 60B.

In addition, when the second switch 81*b* is ON, the control device 80 magnetizes the solenoid of the fourth working valve 104 to switch the fourth working valve 104 to the second position (an allowing position) 104*b*. When the fourth working valve 104 is in the second position 104*b*, the hydraulic fluids in the working fluid tubes 43*a*, 43*b*, 43*c*, 43*d*, 43*e*, and 43*f* pass through the fourth working valve 104 and are outputted to the operation fluid tank 22 and the like (the operation fluid is allowed to be outputted from the fourth outputting fluid tube 100 to the operation fluid tank 22).

As described above, by switching the fourth working valve 104, the warming up of the working fluid tubes 43*a*, 43*b*, 43*c*, 43*d*, 43*e*, and 43*f*, that is, the warming up of the operating hydraulic system is carried out. Meanwhile, a relief valve 105 and a check valve 106 may be disposed on the fourth outputting fluid tube 100.

Figure 6B:
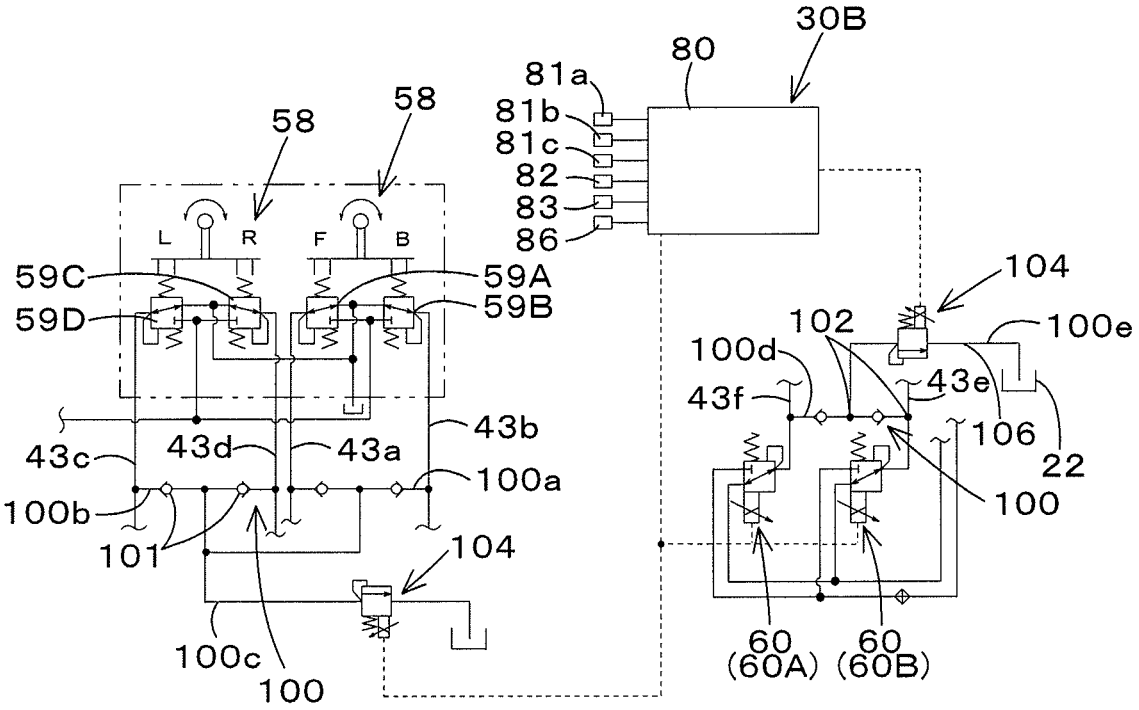
FIG. 6B is a view illustrating a modified example of the operating hydraulic system according to third embodiment.

As shown in FIG. 6B, the fourth working valve 104 may be constituted of a variable relief valve. In the case where the fourth working valve 104 is constituted of the variable relief valve, the operation of the fourth working valve 104 is the same as the operation shown in the first embodiment. Thus, the control device 80 changes the set value of the fourth operating valve 104, and thereby the warming up of the operating hydraulic system is carried out.

As shown in FIG. 6B, when the fourth operation valve 104 is constituted of a variable relief valve, the fourth working valve 104 may be switched in accordance with the outside temperature or the fluid temperature as described in the first embodiment. For example, under a state where the fluid temperature measured by the measuring device 82 is equal to or lower than a threshold temperature (−10° C.) that is low and the viscosity of the hydraulic fluid is high, the control device 80 outputs a control signal to the fourth working valve 104, and thereby the set pressure of the fourth working valve 104 is reduced.

In this manner, under the state where the fluid temperature is low and the viscosity is high, the hydraulic fluid in the outputting fluid tube 40 is returned to the operation fluid tank 22 and the like through the fourth outputting fluid tube 100, and thereby the warming up is carried out.

In addition, the control device 80 may reduce the set pressure of the fourth working valve 104 when the load measured by the measuring device 83 is equal to or higher than a threshold value, and may control the set pressure of the fourth working valve 104 not to be reduced when the load is less than the threshold value. In addition, when the fluid temperature measured by the measuring device 82 is equal to or less than the threshold value, the control device 80 may decrease the set pressure of the fourth working valve 104 and thereby may reduce the pressure of the hydraulic fluid to be lower than usual under the state where the upper limit value of the engine revolution speed is suppressed.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

The configurations of the first working valve, the second working valve, the third working valve, and the fourth working valve may be changed respectively. The first working valve, the second working valve, the third working valve, and the fourth working valve may be constituted of a proportional valve configured to change the opening aperture, a balanced relief valve, a pilot check valve, and the like in addition to the two-position switching valve and the variable relief valve described above. In addition, the outputting destination of the hydraulic fluid is the operation fluid tank 22 in the embodiments described above. However, any configurations may be employed as long as the hydraulic fluid can be adequately outputted to the configurations. For example, the configuration may be a suction port of the hydraulic pump or other parts.

Figure 7A:
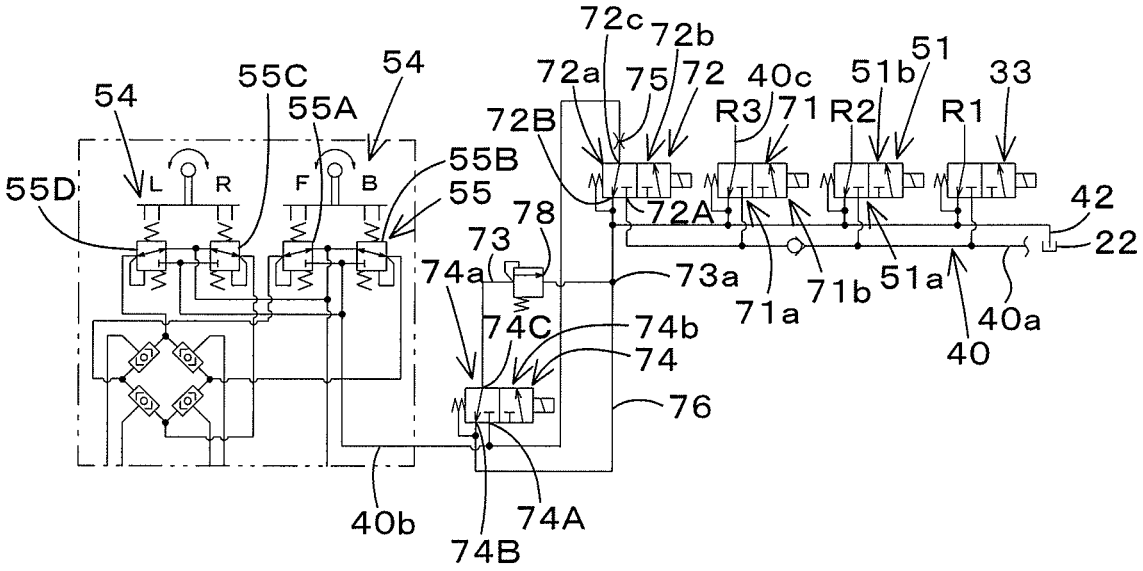
FIG. 7A is a view illustrating another modified example disposing a relief valve on an outputting fluid tube according to the third embodiment.

The check valve 77 shown in FIG. 3A may be replaced with a relief valve 78 as shown in FIG. 7A. That is, the relief valve 78 may be disposed on an intermediate portion of the first outputting fluid tube 73, the relief valve 78 being configured to relieve the hydraulic fluid staying on the side of the first outputting fluid tube 73 to the side of the second outputting fluid tube 76.

Figure 7B:
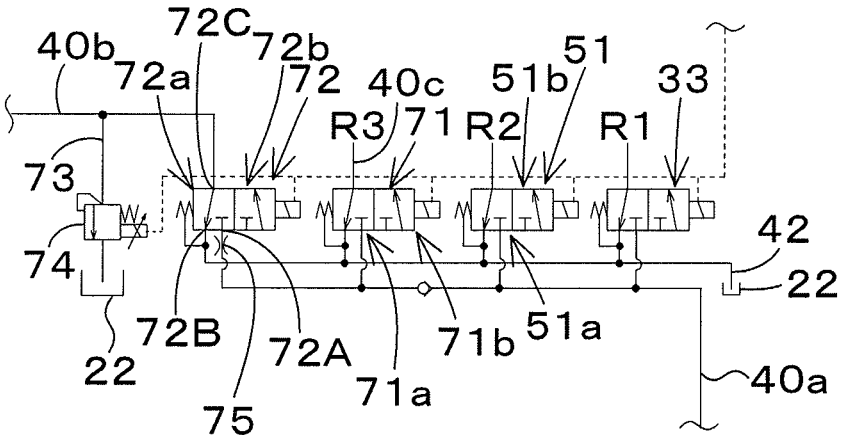
FIG. 7B is a view illustrating further another modified example disposing a throttling portion on a downstream side of the first working valve according to the third embodiment.

In addition, as shown in FIG. 7B, a throttling portion 75 shown in FIG. 1 may be disposed on the upstream side of the first working valve 72 (on the section 40*a* in the vicinity of the first port 72A of the first working valve 72). In other words, the section 40*a* may be provided with a throttling portion 75 between the first working valve 72 And the working hydraulic lock valve 71.

Figure 7C:
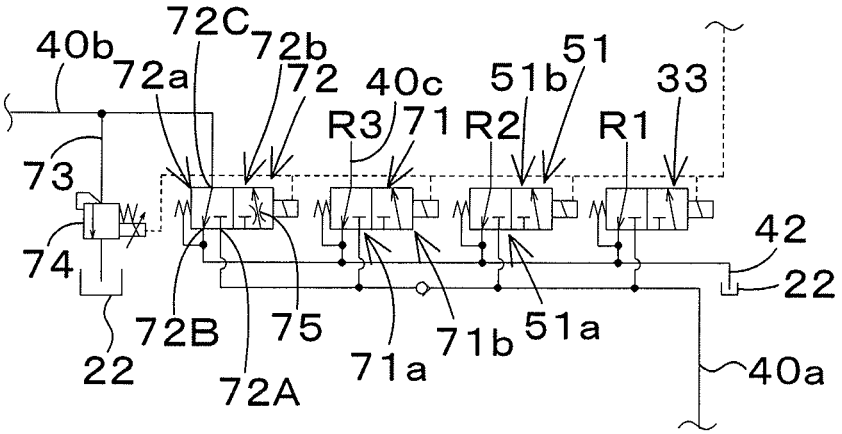
FIG. 7C is a view illustrating further another modified example disposing the throttling portion on an inside of the first working valve according to the third embodiment.

In addition, the throttling portion 75 shown in FIG. 1 may be disposed inside the first working valve 72 as shown in FIG. 7C. That is, when the first working valve 72 is in the second position 72B, the throttling portion 75 may be disposed on the internal fluid tube of the first working valve 72, the first working valve 72 connecting the first port 72A and the third port 72C to each other.

That is, the throttling portion 75 may be disposed at least on the upstream side of the first working valve 72 in the first fluid tube 40, on the downstream side of the first working valve 72 in the first fluid tube 40, or on the interior of the first working valve 72.

Obviously, numerous modifications and variations of the present invention are possible in light of the above teachings. It is therefore to be understood that within the scope of the appended claims, the invention may be practiced otherwise than as specifically described herein.

What is claimed is:

1. A hydraulic system for a working machine, comprising:

a hydraulic pump to output an operation fluid;

a hydraulic apparatus to be activated by the operation fluid;

an operating member to operate the hydraulic apparatus;

an operation valve to determine a pressure of the operation fluid in accordance with operation of the operating member, the operation fluid being supplied to the hydraulic apparatus;

a first fluid tube connecting the hydraulic pump to the operation valve;

a first working valve disposed on the first fluid tube, the first working valve being configured to change an opening aperture of the first working valve;

a first outputting fluid tube connected to a section of the first fluid tube between the operation valve and the first working valve; and a second working valve disposed on the first outputting fluid tube, the second working valve being configured to change an opening aperture of the second working valve, wherein the first working valve is a valve having a supplying position and a blocking position and being configured to be switched between the supplying position and the blocking position, the supplying position to supply the operation fluid to the operation valve, the blocking position to block the supplying of the operation fluid to the operation valve, and wherein the second working valve is a variable relief valve.

2. A hydraulic system for a working machine, comprising:

a hydraulic pump to output an operation fluid;

a hydraulic apparatus to be activated by the operation fluid;

an operating member to operate the hydraulic apparatus;

an operation valve to determine a pressure of the operation fluid in accordance with operation of the operating member, the operation fluid being supplied to the hydraulic apparatus;

a first fluid tube connecting the hydraulic pump to the operation valve;

a first working valve disposed on the first fluid tube, the first working valve being configured to change an opening aperture of the first working valve;

a first outputting fluid tube connected to a section of the first fluid tube between the operation valve and the first working valve; and a second working valve disposed on the first outputting fluid tube, the second working valve being configured to change an opening aperture of the second working valve, wherein the first working valve is a valve having a supplying position and a blocking position and being configured to be switched between the supplying position and the blocking position, the supplying position allowing the first working valve to supply the operation fluid to the operation valve, the blocking position allowing the first working valve to block the supplying of the operation fluid to the operation valve, and wherein the second working valve is a valve having an allowing position and a preventing position and being configured to be switched between the allowing position and the preventing position, the allowing position allowing the second working valve to output the operation fluid of the first outputting fluid tube, the preventing position allowing the second working valve to block the outputting of the operation fluid of the outputting fluid tube.

3. A hydraulic system for a working machine, comprising:

a hydraulic pump to output an operation fluid;

a hydraulic apparatus to be activated by the operation fluid;

an operating member to operate the hydraulic apparatus;

an operation valve to determine a pressure of the operation fluid in accordance with operation of the operating member, the operation fluid being supplied to the hydraulic apparatus;

a first fluid tube connecting the hydraulic pump to the operation valve;

a first working valve disposed on the first fluid tube, the first working valve being configured to change an opening aperture of the first working valve and having a first port to output the operation fluid;

a first outputting fluid tube connected to a section of the first fluid tube between the operation valve and the first working valve;

a second working valve disposed on the first outputting fluid tube, the second working valve being configured to change an opening aperture of the second working valve and having a second port to output the operation fluid;

a second outputting fluid tube connecting the first port of the first working valve to the second port of the second working valve, the second outputting fluid tube being connected to the first outputting fluid tube; and a check valve to supply the operation fluid from the section of the first fluid tube to the second fluid tube and to block the operation fluid flowing from the second fluid tube toward the second fluid tube.

4. A hydraulic system for a working machine, comprising:

a hydraulic pump to output an operation fluid;

a hydraulic apparatus to be activated by the operation fluid;

an operating member to operate the hydraulic apparatus;

an operation valve to determine a pressure of the operation fluid in accordance with operation of the operating member, the operation fluid being supplied to the hydraulic apparatus;

a first fluid tube connecting the hydraulic pump to the operation valve;

a first working valve disposed on the first fluid tube, the first working valve being configured to change an opening aperture of the first working valve and having a first port to output the operation fluid;

a first outputting fluid tube connected to a section of the first fluid tube between the operation valve and the first working valve;

a second working valve disposed on the first outputting fluid tube, the second working valve being configured to change an opening aperture of the second working valve and having a second port to output the operation fluid;

a second outputting fluid tube connecting the first port of the first working valve to the second port of the second working valve, the second outputting fluid tube being connected to the first outputting fluid tube; and a relief valve disposed on the first outputting fluid tube, the relief valve being configured to relieving the operation fluid of the first outputting fluid tube toward the second outputting fluid tube side.

5. The hydraulic system for the working machine according to claim 3, wherein the first working valve is a valve having a supplying position and a blocking position and being configured to be switched between the supplying position and the blocking position, the supplying position allowing the first working valve to supply the operation fluid to the operation valve, the blocking position allowing the first working valve to block the supplying of the operation fluid to the operation valve, and wherein the second working valve is a valve having an allowing position and a preventing position and being configured to be switched between the allowing position and the preventing position, the allowing position allowing the second working valve to supply the operation fluid of the section of the first outputting fluid tube toward the check valve, the preventing position allowing the second working valve to block the supplying of the operation fluid of the section of the first outputting fluid tube toward the check valve.

6. The hydraulic system for the working machine according to claim 1, comprising a throttling portion disposed at least on any one of an upstream side of the first working valve in the first fluid tube, a downstream side of the first working valve in the first fluid tube, and an inside of the first working valve.

7. A hydraulic system for a working machine, comprising:

a traveling hydraulic pump to output an operation fluid;

a charging hydraulic pump other than the traveling hydraulic pump, the charging hydraulic pump being configured to output the operation fluid;

a traveling hydraulic motor to be activated by the operation fluid outputted from the traveling hydraulic pump;

a second fluid tube connecting the traveling hydraulic pump to the traveling hydraulic motor;

a third fluid tube connected to the second fluid tube, the third fluid tube being configured to supply the operation outputted from the charging hydraulic pump to the second hydraulic tube;

a third outputting fluid tube connected to the third fluid tube; and a third working valve disposed on the third outputting fluid tube, the third working valve being configured to change an opening aperture of the third working valve.

8. The hydraulic system for the working machine according to claim 7, wherein the third working valve is a variable relief valve.

9. The hydraulic system for the working machine according to claim 7, wherein the third working valve is a valve having an allowing position and a preventing position and being configured to be switched between the allowing position and the preventing position, the allowing position allowing the third working valve to output the operation fluid of the third outputting fluid tube, the preventing position allowing the third working valve to block the outputting of the operation fluid of the third outputting fluid tube.

10. A hydraulic system for a working machine, comprising:

a hydraulic pump to output an operation fluid;

a working hydraulic apparatus to be activated by the operation fluid;

a working operating member to operate the working hydraulic apparatus;

a working operation valve to determine a pressure of the operation fluid in accordance with operation of the working operating member, the operation fluid being supplied to the working hydraulic apparatus;

a fourth fluid tube connecting the working operation valve to the working hydraulic apparatus;

a fourth outputting fluid tube connected to the fourth fluid tube; and a fourth working valve disposed on the fourth outputting fluid tube, the fourth working valve being configured to change an opening aperture of the fourth working valve.

11. The hydraulic system for the working machine according to claim 10, wherein the fourth working valve is a variable relief valve.

12. The hydraulic system for the working machine according to claim 10, wherein the fourth working valve is a valve having an allowing position and a preventing position and being configured to be switched between the allowing position and the preventing position, the allowing position allowing the fourth working valve to output the operation fluid of the fourth outputting fluid tube, the preventing position allowing the fourth working valve to block the outputting of the operation fluid of the fourth outputting fluid tube.

* * * * *